US006196208B1

(12) United States Patent
Masters

(10) Patent No.: US 6,196,208 B1
(45) Date of Patent: Mar. 6, 2001

(54) DIGITAL IGNITION

(75) Inventor: Stephen C. Masters, El Paso, TX (US)

(73) Assignee: Autotronic Controls Corporation, El Paso, TX (US)

( * ) Notice: Subject to any disclaimer, the term of this patent is extended or adjusted under 35 U.S.C. 154(b) by 0 days.

(21) Appl. No.: 09/182,984

(22) Filed: Oct. 30, 1998

(51) Int. Cl.[7] ..... F02P 3/06
(52) U.S. Cl. ..... 123/597; 127/598
(58) Field of Search ..... 123/597, 598, 123/644

(56) References Cited

U.S. PATENT DOCUMENTS 3,841,287 * 10/1974 Nielsen ..... 123/597
4,502,454 * 3/1985 Hamai et al. ..... 123/597
5,947,093 * 9/1999 Ward ..... 123/598

* cited by examiner

*Primary Examiner*—John Kwon
(74) *Attorney, Agent, or Firm*—Fitch, Even, Tabin & Flannery

(57) ABSTRACT

An electronic ignition system includes a converter for receiving DC power from a source of DC power such as a battery. The convertor converts the DC power at low voltage to a high frequency signal which is stepped up to provide a higher voltage to a charge storage device such as a capacitor. The higher voltage on the capacitor is then made available to an ignition coil under the control of a microprocessor or a microcontroller for providing high voltage electrical energy to one or more spark plugs of an internal combustion engine.

15 Claims, 23 Drawing Sheets

204
RHRD4120
1200U 35V
3.6M R1/2W
MUR190E
PRI
8t. (15 EA.)-26ga.
150t-26ga. SEC
77259-A7
T1
1K
SD103A
P6KE12A
10U
.1U
U1
8 7 6 5
1 2 3 4
.0033U
100 R1W
27.4K 1%
PN200
20K
68K
1N5240
4.7K
D2
6KA24
+12V
1M1002-1
7.5K
.01U
2.87K 1%
4.7 R1/2W
1N4148
+BATT
12ga RED
IGN
RED
LG
PG

MICROPROC. CHAN A
MP+
MP-
8t-24ga. PRI.
8t-24ga. SEC.
ASY17640
212

+12V
330U
10U
.1U
LG
IGNI/TRIG
750
220
.01U
210
PN100
10K
1K
VGATE
.001U
PN200
1N4148
1K
PG
100
1N5245
IRGBC40F
4.7U 630V
4.7U 630V
C+ ORANGE
C- BLACK
6A CHOKE
18T 21AWG
ASY17495

MP+
MP-
1N4001
10
R1/2W
330U
1N4749
RFSUPR
.022U
100
.1U
MIC 2950-05BZ
IN
POSITIVE VOLTAGE REGULATOR
OUT
+5V
22U
1.0U
.1U
302
PIC16C62
MCLR
RA0
RA1
RA2
RA3
RA4
RA5
VSS
OS1
OS2
RC0
RC1
RC2
RC3
RC4
RC5
RC6
RC7
VSS
VDD
RB0
RB1
RB2
RB3
RB4
RB5
RB6
RB7
1N5232
SWITEST
1K
MSEN IN
MSEN OUT
SD103A
2K
.0022U
100
27pf
15MHz

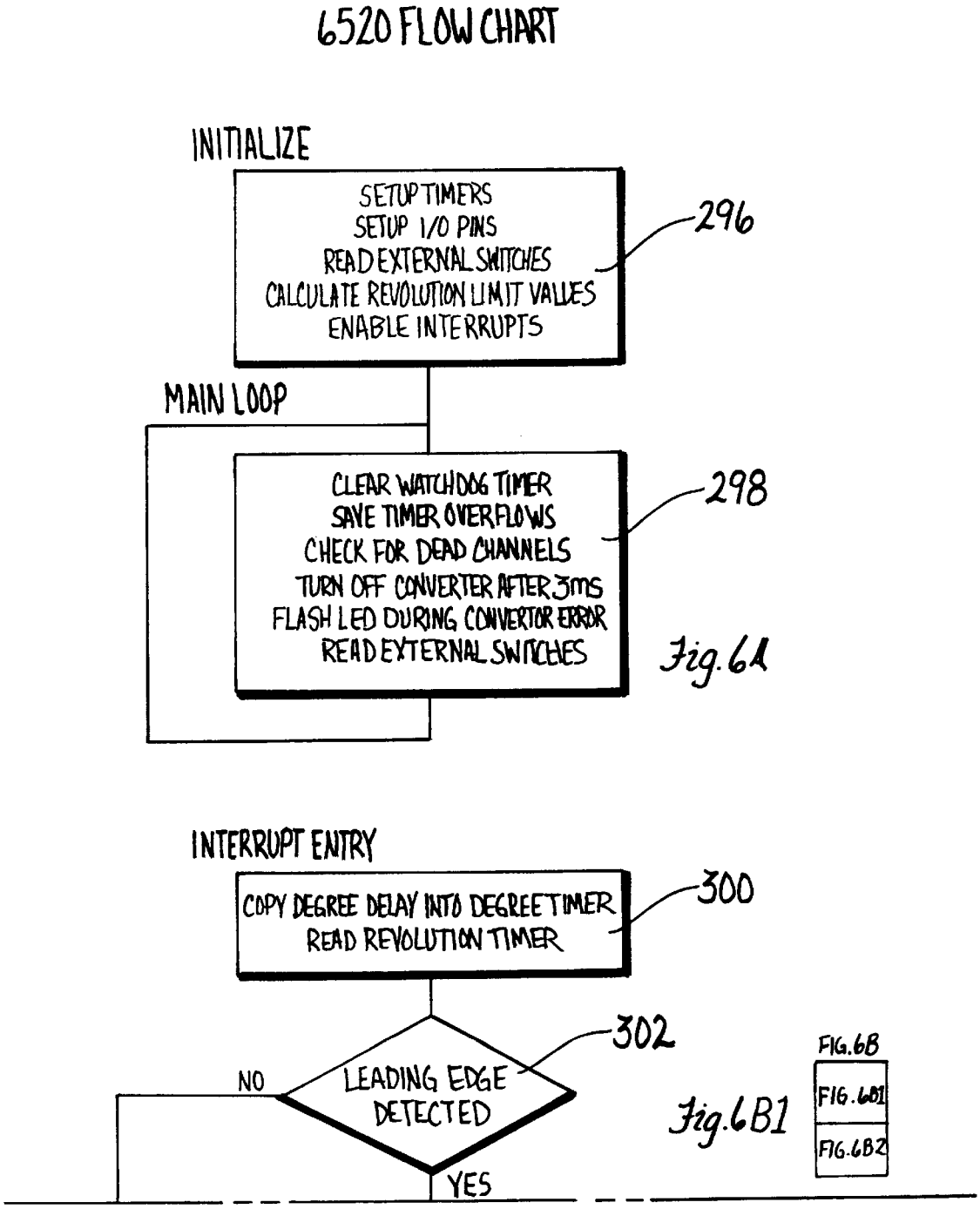
6520 FLOW CHART
INITIALIZE
SETUP TIMERS
SETUP I/O PINS
READ EXTERNAL SWITCHES
CALCULATE REVOLUTION LIMIT VALUES
ENABLE INTERRUPTS
296
MAIN LOOP
CLEAR WATCHDOG TIMER
SAVE TIMER OVERFLOWS
CHECK FOR DEAD CHANNELS
TURN OFF CONVERTER AFTER 3ms
FLASH LED DURING CONVERTOR ERROR
READ EXTERNAL SWITCHES
298
Fig. 6A
INTERRUPT ENTRY
COPY DEGREE DELAY INTO DEGREE TIMER
READ REVOLUTION TIMER
300
LEADING EDGE DETECTED
302
NO
YES
Fig. 6B1
FIG. 6B
FIG. 6B1
FIG. 6B2

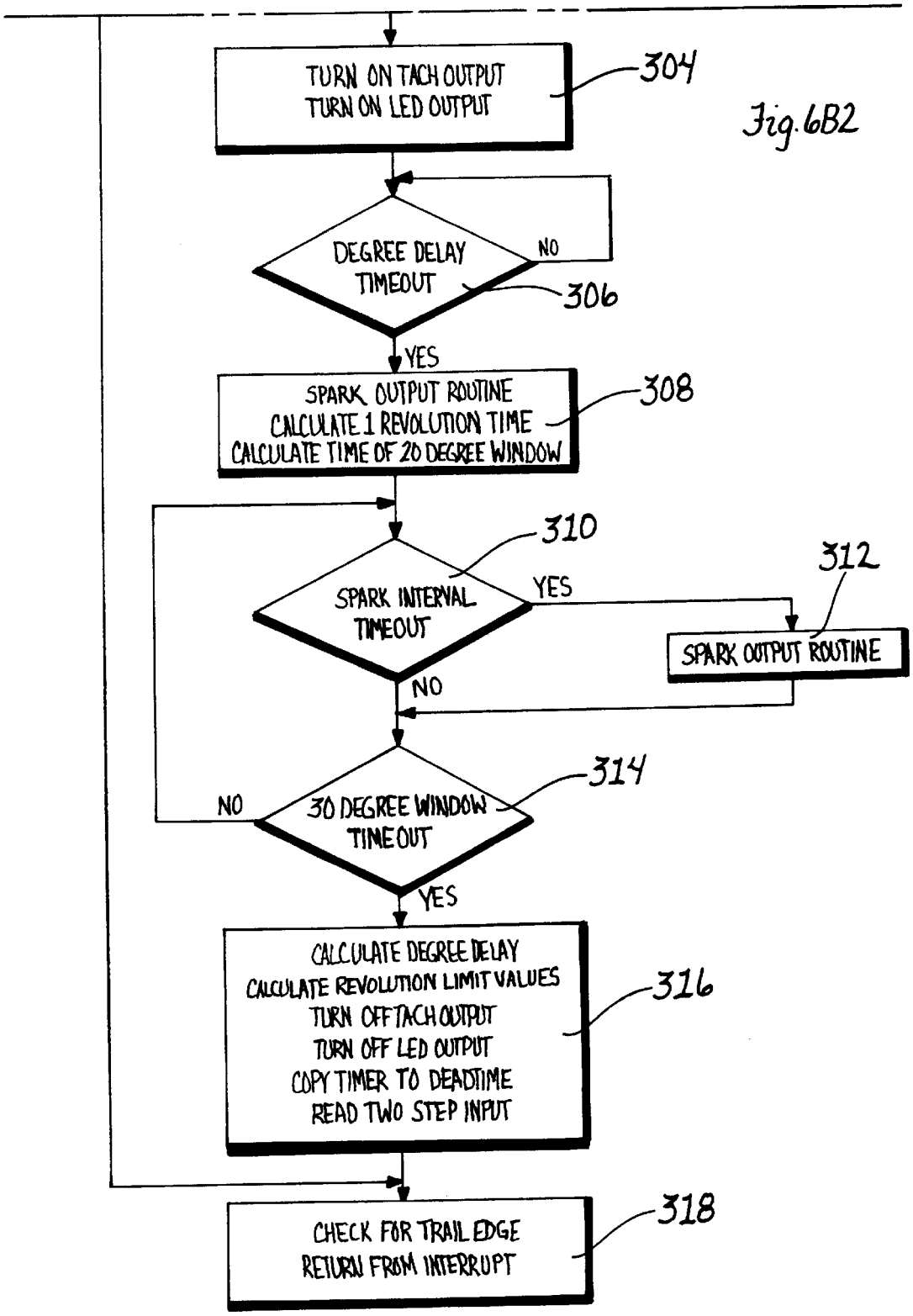
Fig. 6B2

8975 FLOW CHART
INITIALIZE
SETUP TIMERS
SETUP I/O PINS
READ EXTERNAL SWITCHES
SETUP PWM OUTPUT
ENABLE INTURRUPTS
346
MAIN LOOP
CLEAR WATCHDOG TIMER
SAVE TIMER FOR OVERFLOWS
CHECK FOR DEAD CHANNEL
FLASH LED FOR ERROR
READ EXTERNAL SWITCHES
348

INTERRUPT ENTRY
COPY DEGREE DELAY INTO DEGREE TIMER
READ REVOLUTION TIMER
350
LEADING EDGE DETECTED
352
NO
YES
Fig. 7B1

FIG. 7B1
FIG. 7B2

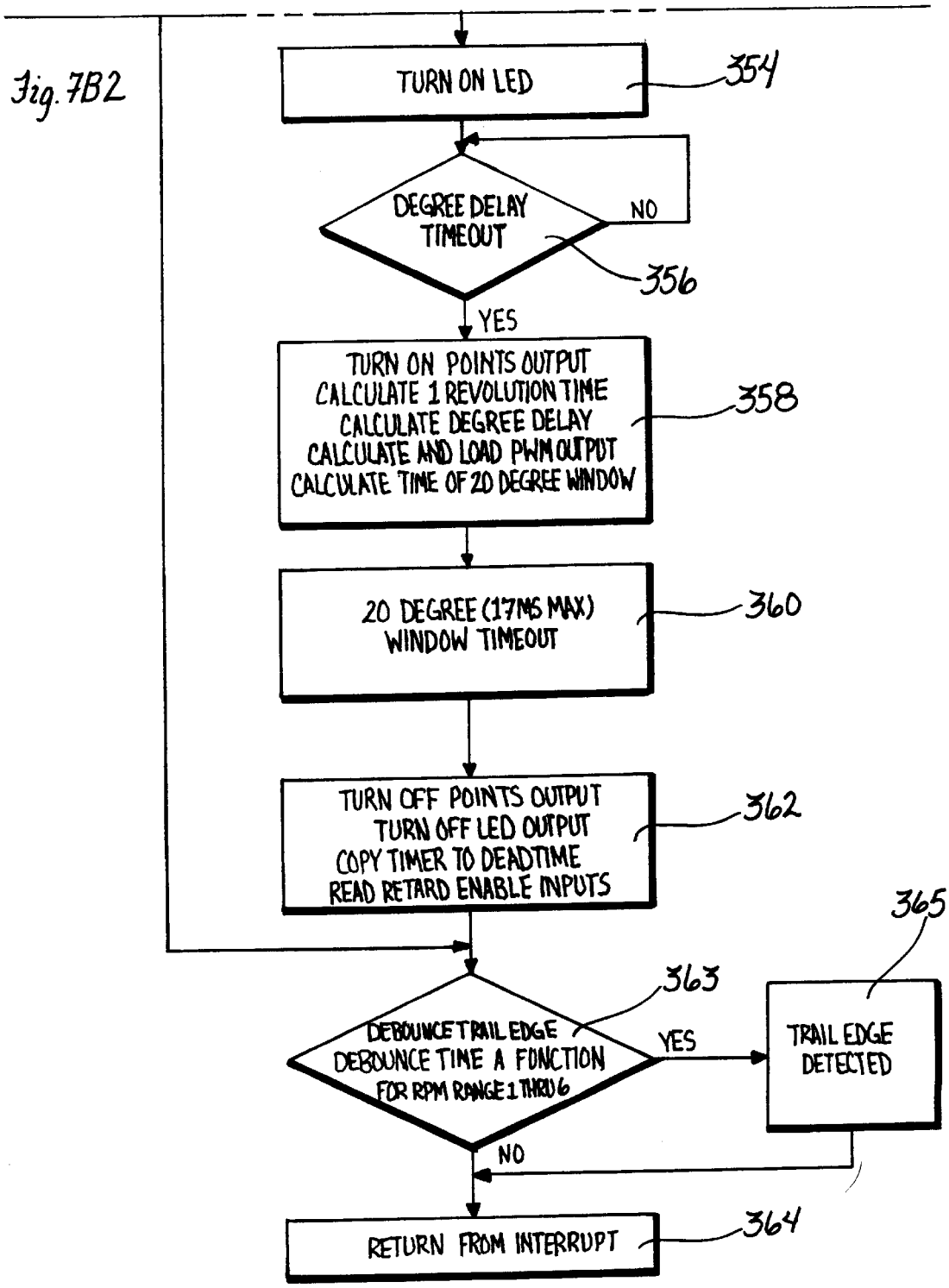
Fig. 7B2
TURN ON LED
354
DEGREE DELAY TIMEOUT
NO
356
YES
TURN ON POINTS OUTPUT
CALCULATE 1 REVOLUTION TIME
CALCULATE DEGREE DELAY
CALCULATE AND LOAD PWM OUTPUT
CALCULATE TIME OF 20 DEGREE WINDOW
358
20 DEGREE (17MS MAX) WINDOW TIMEOUT
360
TURN OFF POINTS OUTPUT
TURN OFF LED OUTPUT
COPY TIMER TO DEADTIME
READ RETARD ENABLE INPUTS
362
365
363
DEBOUNCE TRAIL EDGE
DEBOUNCE TIME A FUNCTION
FOR RPM RANGE 1 THRU 6
YES
TRAIL EDGE DETECTED
NO
RETURN FROM INTERRUPT
364

Fig. 10B
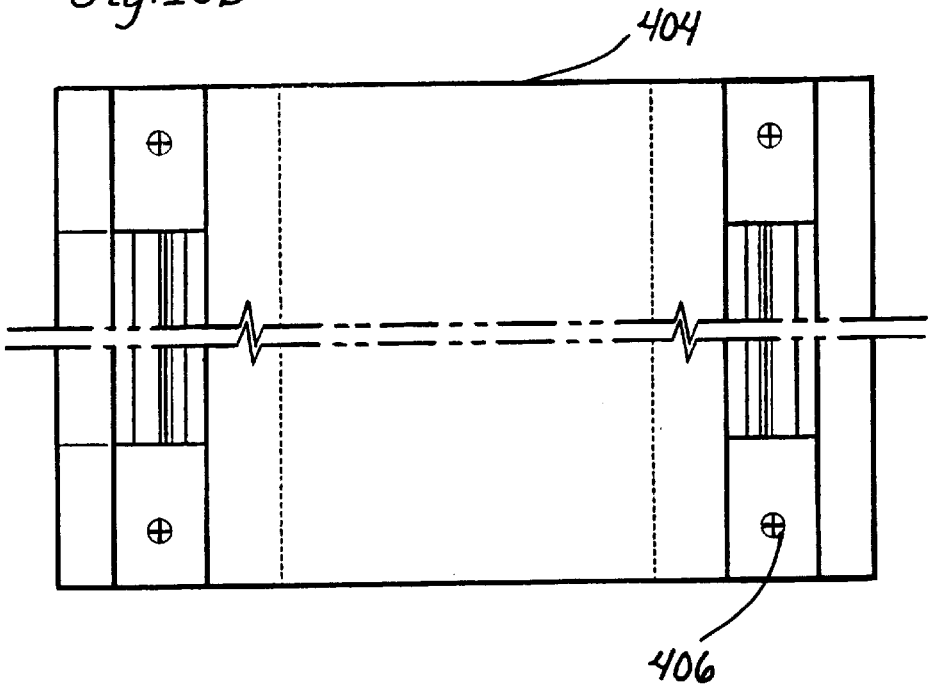
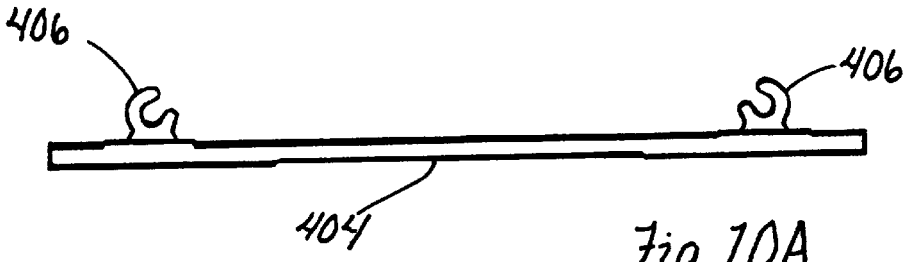
Fig. 10A

DIGITAL IGNITION

BACKGROUND OF THE INVENTION

1. Field of the Invention

The present invention relates to ignition systems for internal combustion engines and, more particularly, to an improved digital automotive ignition for providing higher performance and increased noise immunity.

2. Description of the Related Art

Modern ignition systems are designed to optimize engine performance. One such ignition system is shown in U.S. Pat. No. 5,526,785, assigned to the assignee of the present application. The system of the '785 patent provides enhanced timing circuitry to optimize spark timing and improve engine performance. The embodiment of the system disclosed in the '785 patent is embodied in analog circuitry using a single shot flyback transformer with SCR (silicon controlled rectifier) switches. While the system of the '785 patent provides improved performance over prior ignition systems, it is desirable to provide yet further enhancements to engine performance.

SUMMARY OF THE INVENTION

An ignition system according to an embodiment of the present invention includes a power circuit and a timing circuit. The timing circuit includes a microprocessor or microcontroller to provide for engine control. The microcontroller supervises, for example, multispark, rev limit and retard controls. The power circuit includes a variety of overvoltage protection circuitry and employs a reduced size toroid flyback transformer and employs an IGBT (insulated gate bipolar transistor) ignition coil switch.

BRIEF DESCRIPTION OF THE DRAWINGS

A better understanding of the present invention is obtained when the following detailed description is considered in conjunction with the following drawings in which:

FIGS. 6A–6B are a flow diagram of a first embodiment of the digital ignition system in operation;

FIGS. 10A–10B are cross-sectional view of the base of the system housing of FIG. 8;

DETAILED DESCRIPTION OF THE INVENTION

Figure 1:
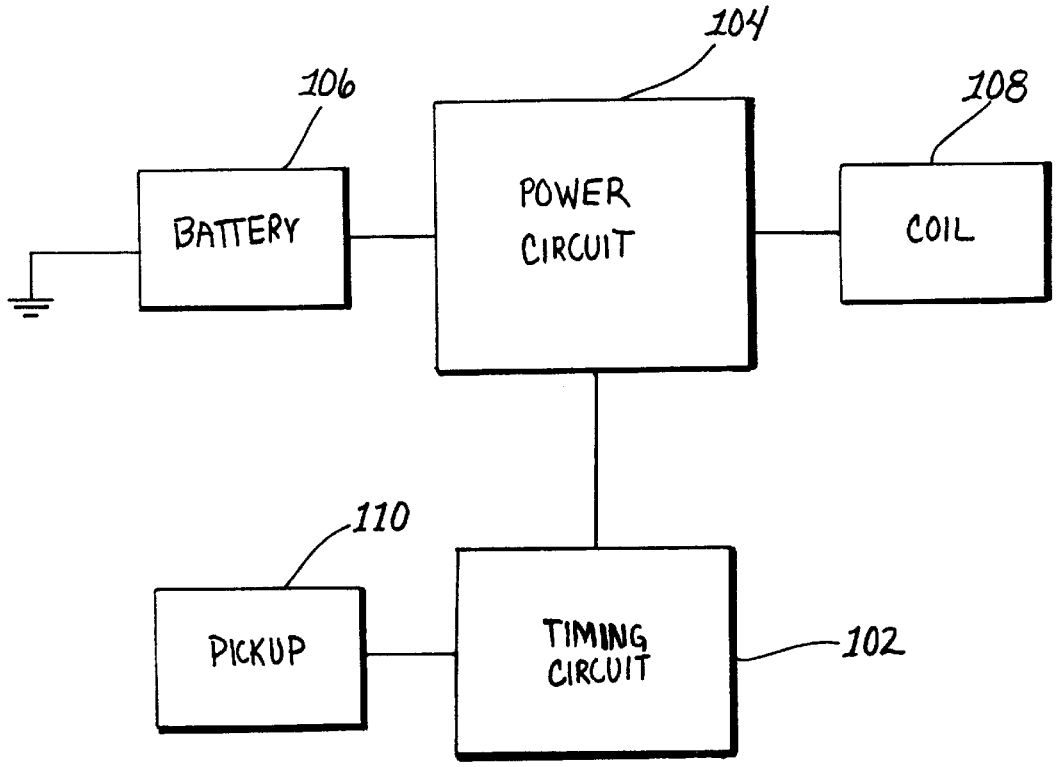
FIG. 1 is a block diagram of a digital ignition system according to an embodiment of the invention.

Turning now to the drawings and with particular attention to FIG. 1, a block diagram illustrating a digital ignition system 100 according to an embodiment of the present invention as shown. The digital ignition system 100 includes a power circuit 104 and a timing control circuit 102. A pick-up 110 operates in a well-known manner to detect a particular position on a rotating shaft (not shown). A signal is generated by the pick-up 110, which is connected to the timing control circuit 102.

A battery 106 provides a DC current with sufficient power to allow a power converter in the ignition circuit 104 to step up the voltage and store this energy in a capacitor to be later discharged into the ignition. coil 108. The ignition power circuit 104 converts the battery voltage to a high voltage stored in a capacitor for application to the ignition coil 108. As will be discussed in greater detail below, the arrangement of FIG. 1 includes a microcontroller 302 (FIG. 3) in the timing control circuit 102 which is used to control operation of the ignition. According to one embodiment, the microcontroller 302 is a Microchip PIC 16C62A microcontoller.

Figures 2, 2A, 2B, 2C, 2D:
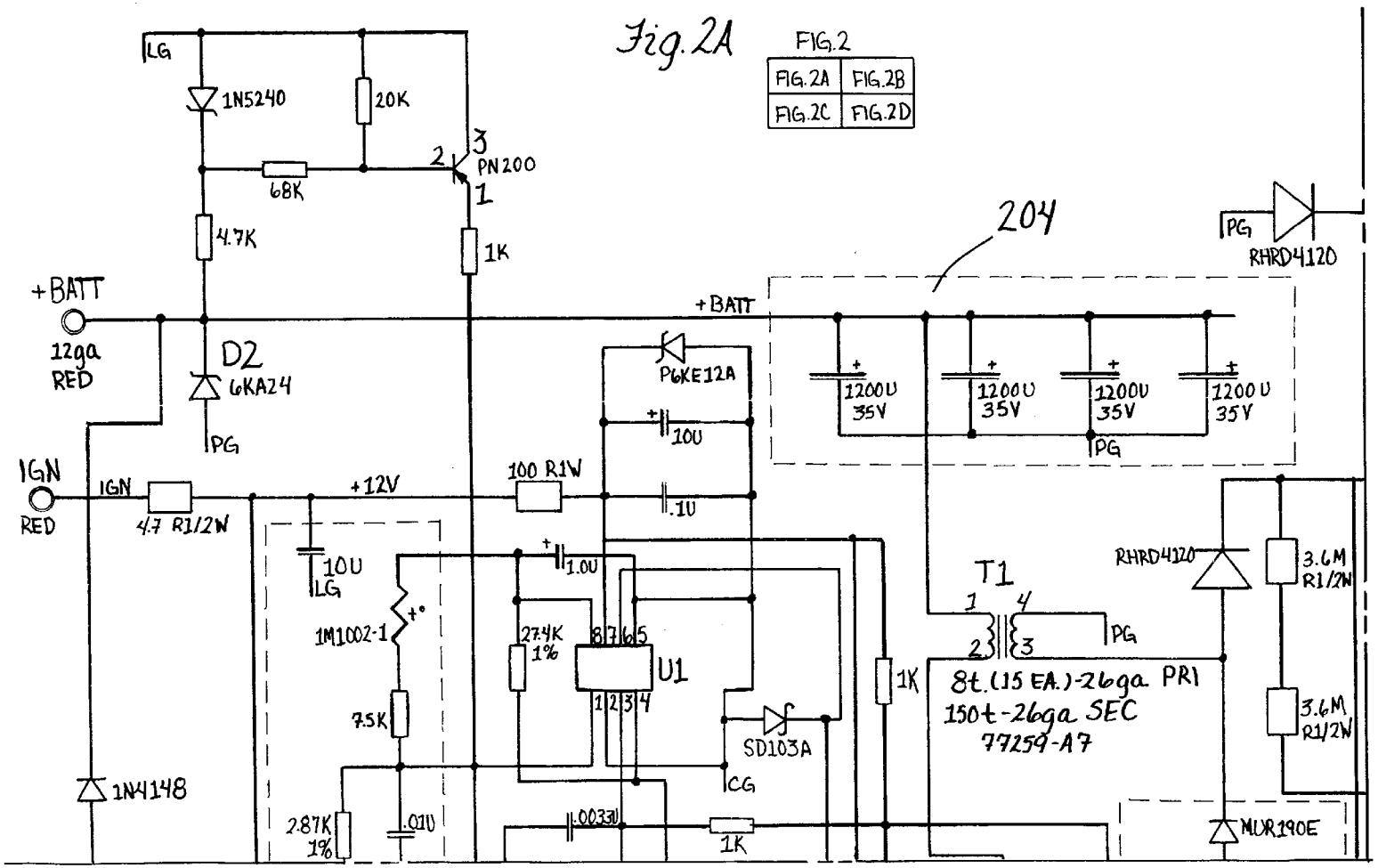
FIG. 2 is a circuit diagram of a power section of the digital ignition system of claim 1.
Figure 2B:
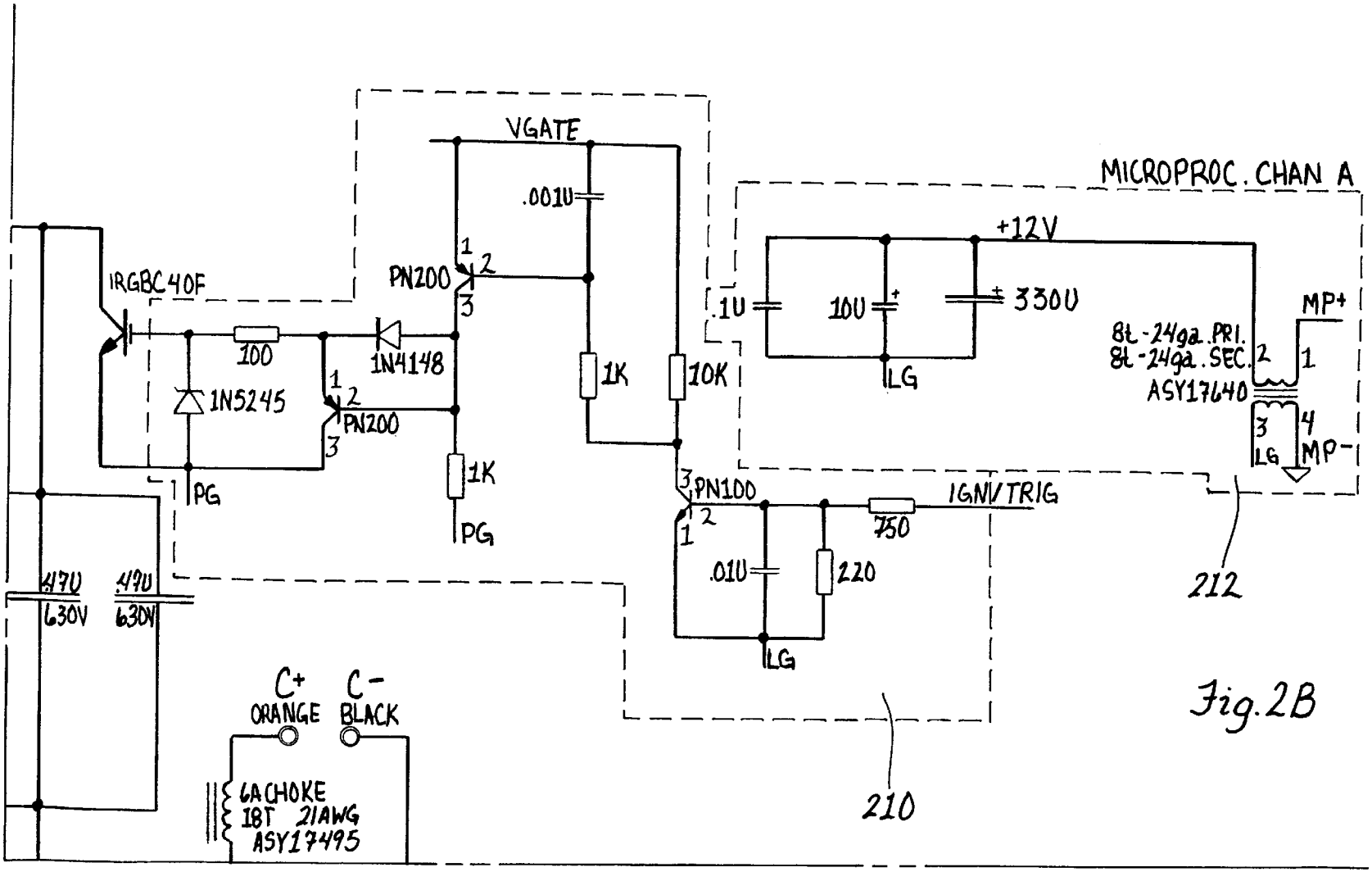
Figure 2C:
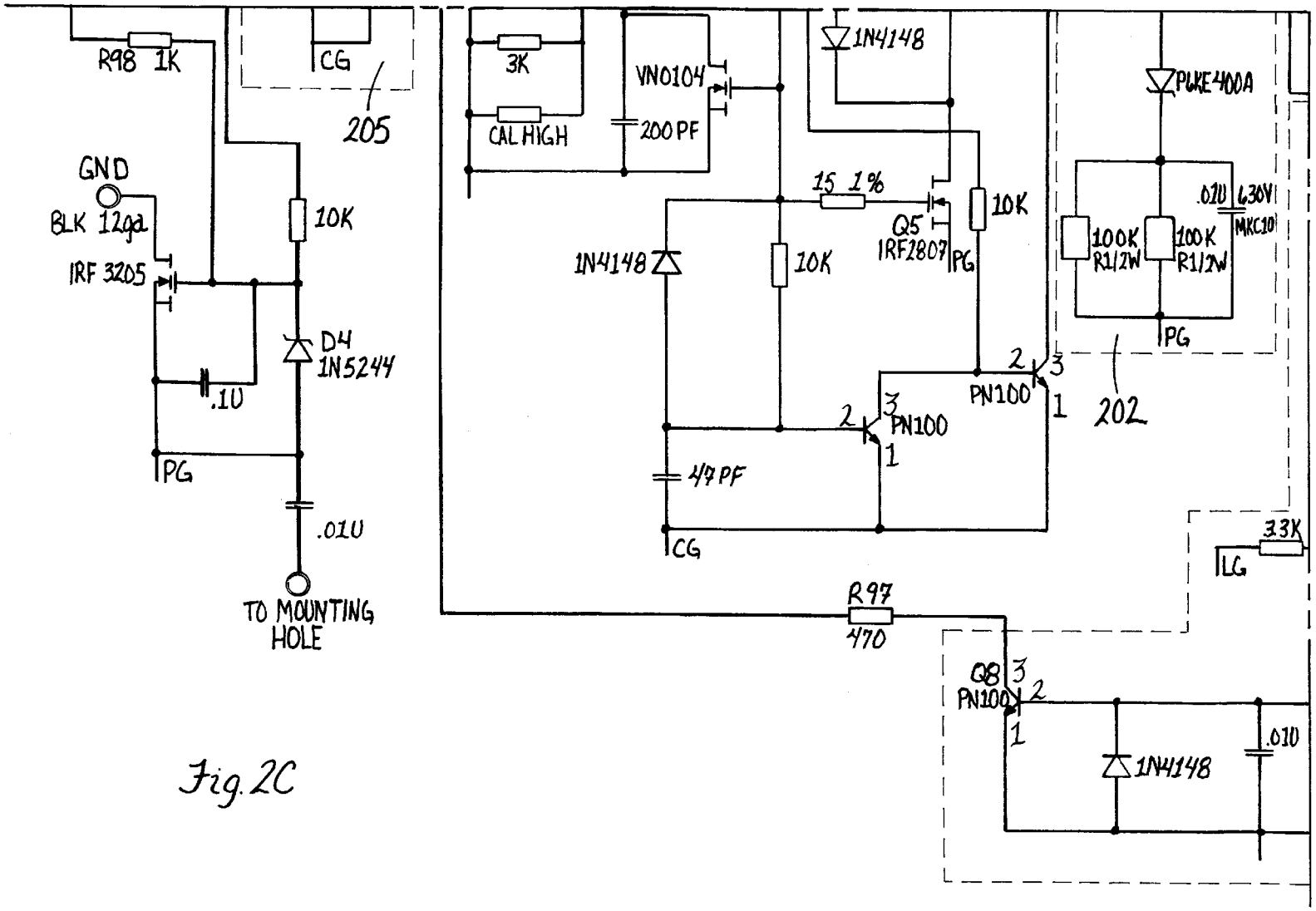
Figure 2D:
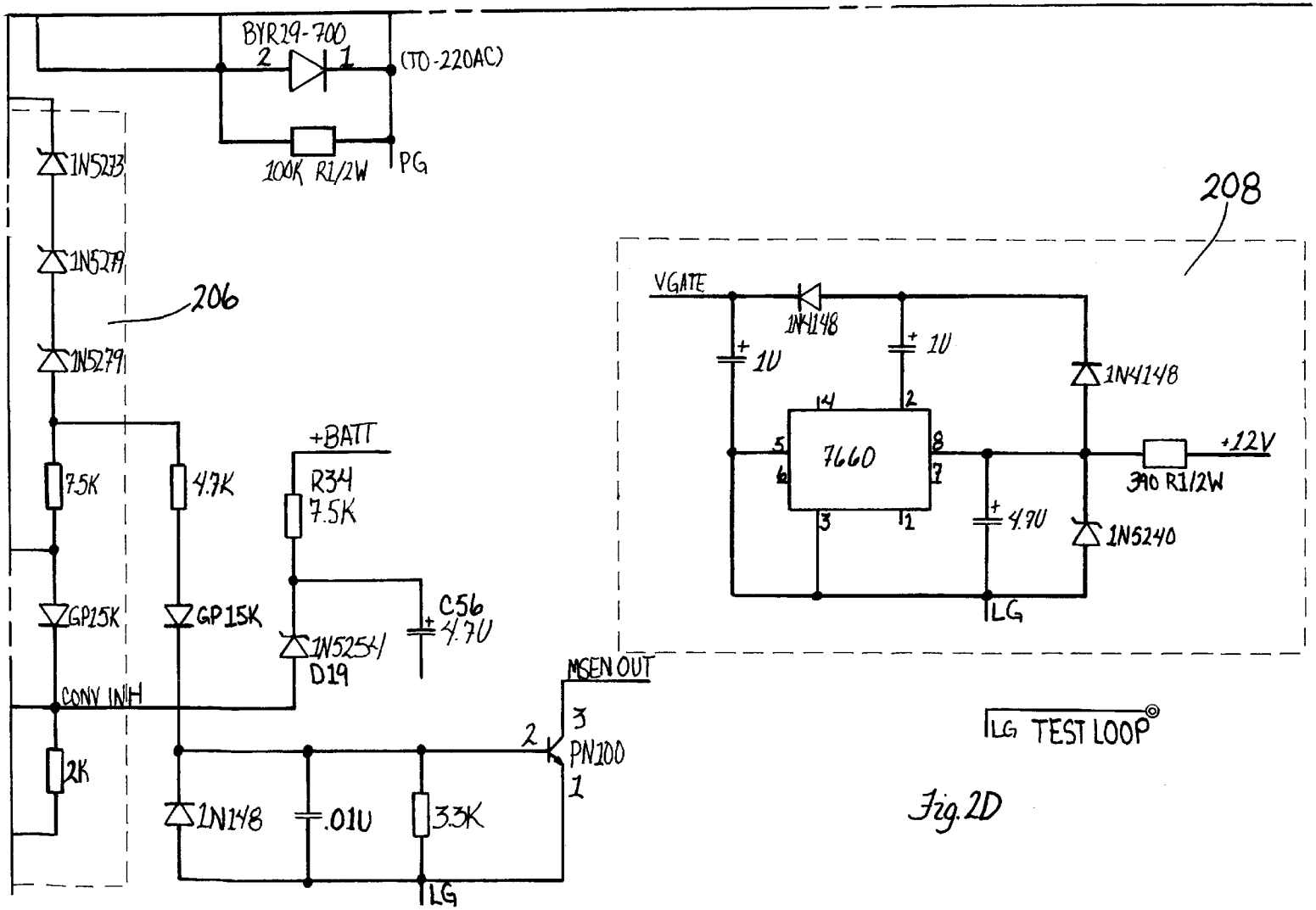

In particular, turning now to FIG. 2, a circuit diagram of an exemplary ignition power circuit 104 according to the present invention is shown. The power circuit 104 includes a power section which includes a current mode control integrated circuit U1, which may be a UCC 3803 or a UCC 3805 available from Unitrode. The ignition input IGN is received from the automobile battery (not shown), typically a 12.6 volt DC secondary type lead acid battery. This ignition input IGN voltage ranges from a low of about 6 volts during cold cranking to as high as 16 volts under overcharge at cold temperatures. The ignition input IGN is also subject to "load dump" and transient voltages as high as +/−200 volts for microseconds duration. The load dump condition may increase the battery level to as high as +150 volts for up to 50 milliseconds. The ignition input is also subject to being connected with reverse polarity of the battery input wires. Accordingly, a variety of input protection circuitry is provided.

The power circuit 104 is first protected from battery reversal by using a high current power MOSFET Q3 that is reverse-biased when the battery is connected backwards. The inherent body diode of the power MOSFET Q3 blocks the reverse potential and provides protection for all the ignition circuitry. When the battery is connected correctly to the +BATT battery and ground GND inputs, current can flow from the battery through the ignition. When the ignition switch applies voltage to the ignition input IGN, the gate of the transistor Q3 is biased on and the voltage drop across the drain-source terminals of the transistor Q3 drop to several millivolts, becoming a near lossless protection device. The on state resistance of the transistor Q3 is about 8 milliohms, so at an average input current of 10 amperes the voltage drop is I×R=Vdrop=80 millivolts and power dissipation is V×I=P=800 milliwatts, average. The Zener diode D4 clamps the Q3 gate to a maximum of 14 volts for gate protection and R9 limits current through the diode D4 fully protecting the power transistor Q3 from voltage spikes present on the IGN input wire.

The Zener diode D2 acts as a second input protection device, functioning as a transient surge absorber. The diode D2 is capable of absorbing and clamping an alternator's "load dump" output. The diode D2 is, for example, a 6KA24, available from General Instrument, Inc., and is rated at 6000 watt clamp power for 50 milliseconds at 45 volts maximum clamp voltage. This diode D2 begins clamping above 26 volts input. Therefore, the ignition must be capable of operation up to this input voltage for limited duty cycle. The diode D2 also protects the circuit from negative voltages greater than the avalanche breakdown voltage of the power transistor Q3.

In particular, when the battery input voltage +BATT has a negative transient greater than 55 volts, the ignition is protected in several ways. First, the negative transient must have enough potential to break down Q3. To do so, however, requires that the transient potential be about −55 volts plus battery output of −13 volts=−68 volts minimum before current would begin to flow. The gate is turned off first, then the breakdown of the drain-source junction allows current to flow. When the current begins to flow, the diode D2 is forward biased at about 0.7 volts and shunts the entire ignition from any negative current flow. The diode D2 and the transistor Q3 provide clamping action to protect the other ignition components from negative voltage transients. A resistor R98 may be used to provide an RC time constant or filter effect at Q3 gate. This insures that the +BATT noise will not discharge the gate voltage at Q3 gate under normal operation. This ensures that Q3 stays fully enchanced (on).

The converter section is a high frequency flyback step-up convertor. It includes the current mode control IC, U1, which includes input power conditioning, clamping components, temperature feedback sensing, $R_{dson}$ current feedback sensing, over-voltage shutdown and under-voltage fold-back circuits. Also included are a powdered metal-power torroid transformer T1, power MOSFET switching transistor Q5, which may be a 75 volt, 71 ampere rated transistor, output snubber circuitry 202, and power diode D7 output and output capacitors C14, C15. As mentioned above, the control IC U1 is a Unitrode UCC3803 or UCC3805 current mode control BiCMOS device. This control IC 340 U1 controls the operation of the convertor to convert the battery input voltage to a potential of 525–540 volts DC, which is stored in the output capacitors C14 and C15. These capacitors are 630 volt, 0.47 microfarad, pulse rated MKP type. The convertor is a "flyback type" which stores energy in the T1 transformer primary when the transistor Q5 is on and transfers the energy to the secondary when transistor Q5 turns off, which then charges up C14 and C15. This occurs at a frequency of between 40 kHz and 110 kHz. The charge time from zero volts to 535 volts is typically less than 750 microseconds with the battery input at 14 volts DC. This gives an energy stored in C14, C15 of −Capacitance× (Voltage)squared/2=Joules. At 535 volts and 0.94 microfarad, 134 millijoules of energy are stored that can be switched to the ignition coil primary connected to the ignition output wires (C− and C+). The U1 IC operates in fixed off-time-variable frequency current mode for providing stable operation from the minimum start-up voltage of 4.5 volts to over 24 volts input. As the voltage begins to ramp up at C14, C15, the convertor frequency starts at a high frequency of about 100 kHz and a very narrow duty cycle, or on time, of a few microseconds. As the voltage ramps up, the frequency gradually lowers to about 40 kHz at cut off when C14, C15 reach full charge of 525–535 volts. The fixed off-time is set at about 9 microseconds, giving enough time for the transfer of primary energy to the secondary before the primary current is turned back on.

The converter operates by turning on the output at pin 6 of the control IC U1 to bias the gate of Q5 on, allowing primary current to flow in T1. The output pin 6 also biases the base of the transistor Q4 on, which clamps the oscillator input pin 4 of U1 in the reset state, and pin 6 biases the base of the transistor Q6 on which clamps base of the transistor Q7 off, allowing the voltage at the anode of the diode D6 to rise to the on state forward voltage drop across Q5 plus the 0.6 volt forward drop of the diode D6. The voltage at the diode D6 is representative of the current flowing through the transistor Q5 (i.e., $I=V/R_{dson}$). This voltage is used for current feedback at pin 3 of the control IC U1. The resistors R10/R12-R11 form a voltage divider at the input pin 3 of the control IC U1. As the Q5 curry amps up, the voltage across the drain-source terminals rises until the level is reached when the pin 3 voltage is equal to the internal comparator which is seen in part at pin 1 (comp) of the control IC U1. The voltage level at pin 1 is compared internally to the pin 3 voltage and when the pin 3 voltage exceeds the pin 1 internal voltage, the comparator resets the output latch. This causes the output pin 6 of the control IC U1 to turn off and the transistor Q5 turns off. This action attempts to maintain a constant current flowing through the transistor Q5 and the T1 primary winding. When pin 6 of the control IC U1 goes low, the base of the transistor Q4 is biased off and the oscillator begins to ramp up the voltage at pin 4 of U1. This time period is the fixed off time because it now takes about 9 microseconds until the voltage level on pin 4 triggers the internal comparator to again set the output latch on. This off time is controlled by the transistor Q4 turning off, the resistor R6 charging up the capacitor C11 until the internal oscillator threshold is reached to set the output latch on. When the output pin 6 goes low, the base of the transistor Q6 is quickly biased off and allows the base of the transistor Q7 to bias on; Q7 then clamps the voltage at the anode of the diode D6, bringing the voltage at pin 3, the current sense input pin of U1 to near ground potential (i.e., about 0.6 to 0.8 volts clamped). The purpose of C12, R15 and D5 is to allow quick turn off of Q6 but also allow a small delay at turn on of Q5. The capacitor C12 must charge to 0.6 volt through R15 before Q6 is biased on. The delay from pin 6 going high to Q7 turn off is about 250 nanoseconds. This allows Q5 to fully turn on before Q7 unclamps the current sense input at anode of D6. The components R13, D6, Q6, Q7, R15, R16, D5 and C12 are current sense feedback circuitry that enable the use of the resistance of the Drain to Source terminals of Q5 in the ON state ($R_{dson}$) for current sensing, which is lossless (i.e., no shunt current sense resistors or other current sensing circuitry is required).

The use of $R_{dson}$ requires that the on state resistance either be very stable over temperature or that temperature compensation be used to nullify the increase in Q5 $R_{dson}$ as temperature rises. This is done with the temperature compensation circuitry 205, including resistor TR1, R7, R8, and C8. This circuit includes a thermistor TR1 in series with R7, which limits the maximum gain of the thermistor TR1 over the operating temperature range, and provides a current that parallels the internal control IC U1 current source at pin 1 to produce a voltage across the resistor R8, which is the current level reference used internally by the control IC U1 for current mode control. The Control IC U1 drives a maximum 200 microamperes output at pin 1 which decreases with increasing temperature. The external thermistor TR1 and resistor R7 shunt the internal current source to pin 1, as well as increase the current to pin 1 as temperatures rise in the circuit. This operation offsets both the drift in the current reference at pin 1 and the change in $R_{dson}$ Both of these circuit drifts are compensated by the thermistor TR1, which slightly increases the pin 1 voltage to keep the convertor current level in the transformer T1 at the optimum level regardless of temperature rise in the U1 and Q5 devices.

The pin 1 voltage is also compensated by the battery level. When the battery falls below 10 volts, the pin 1 voltage is lowered to track the battery so that the convertor cannot ask for more current than is possible. Since the convertor must ramp the current up to the constant level each cycle, the convertor must be able to reach this level for any battery voltage input within the operating range (typically 6 to 24 volts). At above 10 volts, the power MOSFET Q5 is turned on fully with a gate drive over 10 Vgs. But as the battery input falls below 10 volts, the transistor Q5 cannot be fully enhanced so the current level must be derated to keep the Q5 in a safe area operation mode. This is accomplished by the circuitry of R1–R4, D1 and Q1. The battery voltage is monitored by transistor Q1 which is biased by R3, R1 and R2 and clamped to 10 volts by Zener diode D1. When the battery voltage is above 10 volts, the base of the transistor Q1 is reverse biased and no current flows from emitter to collector to ground. As the battery voltage drops below 10 volts, the base current begins to flow and lowers the pin 1 voltage. The pin 1 voltage then tracks the battery voltage as it drops to lower values. At approximately 6.5 volts, the convertor current is lowered to a level of about ½ the 14 volt level, which requires the charge time to double to charge the C14, C15 capacitors to the 535 volt output value. Also, at this low battery input condition, the power MOSFET Q5 is about 75% enhanced, but is still able to reach the current trip level to reset the U1 internal current comparator and operate in the current mode of operation with reduced current drive to T1. This provides safe operation of the power MOSFET Q5 below 10 volts input and prevents what otherwise would be a current runaway condition. The power MOSFET Q5 also provides protection from a current runaway condition because at low gate drive levels when the Q5 is not fully enhanced, the voltage across the Drain to Source terminals of Q5 in the ON state ($V_{dson}$) is higher, which feeds the current sense circuit and turns the output off at a lower current level. Thus, it is self-protecting using $R_{dson}$ as the current sensing mechanism.

The C14, C15 voltage is regulated to the 525–535 volt level by the voltage feedback circuity 206, which includes Q8, D20, C22, R37, D17, R32, R33 and D14–16. When the capacitor voltage rises to just over the reverse breakdown voltage of the Zener string D14–16, of about 520 volts, then the base of transistor Q8 becomes biased via D17 and R32, in series with D14–16. When the transistor Q8 is biased on, the Q8 collector clamps pin 1 of U1 to near ground. When pin 1 falls below 1 volt, the convertor is shut down and stops charging C14, C15. The capacitor C22 at the base of Q8 filters noise at the base/emitter and provides a slight delay before Q8 turns off after C14, C15 are discharged. Also, the capacitor C8 on pin 1 provides a small delay of about 20 microseconds and rise time of pin 1 voltage of about 50 microseconds that allows a soft start of the convertor, when it turns back on to recharge C14, C15.

Since operation with high battery input voltages is undesirable, the ignition is designed to shut down the convertor section at about 27–29 volts; the voltage levels at the drain-source of the power MOSFET Q5 are kept under its maximum rated voltage. When the transistor Q5 turns off after conducting current through the primary winding of transformer T1, the voltage rises quickly to a level that is clamped by the action of the mutual inductance of T1 secondary, which is increasing up to 535–540 volts output. The turns ratio of the transformer T1 limits the maximum voltage that is generated across the primary winding when the transistor Q5 turns off. In particular, the turns ratio of T1 may be, for example, 18.75:1, so at the maximum secondary output of 540 volts, the primary voltage rises to (secondary volts/turns ratio=volts primary)=28.8 volts. The transistor Q5 drain voltage rises to primary volts +(high) battery volts=28.8+29 volts=57.8 volts, well below the maximum rated 75 volt device breakdown.

The convertor is shut down above 29 volts input level by the circuit of R34, R97, D19, C56, Q8, clamping pin 1 of the converter power control IC U1, which is the comp pin. When the battery voltage rises above the reverse breakdown voltage of the Zener diode D19, then the base of the transistor Q8 is forward biased, which then clamps pin 1 of the converter U1. When the voltage at pin 1 of the control IC U1 drops below about 1.2 volt, the gate drive from pin 6 of the control IC U1 stops and Q5 turns off, halting operation and current flow of the Ti primary. As long as the battery remains above this voltage level, the convertor will be shut down and the ignition cannot provide any ignition coil output. In this condition, the transistor Q5 only has the battery voltage potential applied across the drain-source terminals, which is now limited by the clamping action of the diode transient suppressor D2.

The resistor R97 limits the maximum source current of U1 at pin 1 to a level within U1's ability to properly regulate the pin 1 output level. In particular, it should be noted that in certain circumstances where battery input voltage exceeds a particular level, such as aproximately 12.2 V, U1 may operate improperly or unpredictably. Under clamping conditions, it is undesirable to "hard" clamp pin 1 to ground because U1 loses the ability to control pin 1 current supply and U1 would try to oversupply current out of pin 1, thereby resulting in a voltage/duty cycle surge when pin 1 is unclamped. Thus, the resistor R97 provides a "soft" clamp to pin 1 of U1 and properly shuts down the convertor and enables unclamping to resume operation without any surges. It is to be noted that any other current limiting component, such as a current diode, may also be used to provide the soft clamp. The voltage may rise to the maximum clamp voltage of about 45 volts without harming the transistor Q5. The capacitors C52, C53, C54 and C55 of the capacitor bank 204 also help in clamping the input positive transient. With the capacitors C52–C55 charged to the battery potential, when a positive transient occurs, the transient must deliver energy to charge the capacitor bank to the higher level. Because of the limited energy available in the transient source, this will be clamped effectively by the capacitor bank 204 before the diode D2 begins to conduct a large clamp current. The ESR (equivalent series resistance) of the capacitor bank 204 is the primary limiting factor to how well the transient can be clamped and the size of the capacitance limits the voltage rise at a given energy input level. As shown, the ESR for the input capacitors combined are 10 milliohm and 4800 microfarad capacitance. The maximum energy that the capacitor bank could absorb at the maximum clamp voltage of the diode D2 would be: (45 volt-(battery voltage before the transient) squared×capacitance/2=Joules absorbed in capacitor bank. At 45 volt and 14 volt battery @ 4800 microfarad the maximum energy=2.3 Joules. The energy absorbed by the diode D2 is in addition to this. It is noted that this energy is typically seen only at a "load dump" condition with the battery disconnected; otherwise the battery would clamp some (or most of) this energy. The clamp energy required will usually be somewhat less than these maximum values due to the impedances of the battery wiring and PCB wiring resistances.The convertor is also shut down when the output transistor is gated on to discharge C14, C15 into the ignition coil. As will be discussed in greater detail below, this is provided by the microcontroller 302 signal "CONV INH" (converter inhibit) which is also input to the base of Q8, as an ORed input-source only from the microcontroller 302. The timing of the gate signal "IGN/TRIG" is coincident with the "CONV INH" signal so that the convertor is shut down immediately as the ignition coil switch Q2 is biased on. The "CONV INH" signal is turned off low about 30 microseconds before the gate drives turns off to Q2 which allows the pin 1 voltage level to rise to turn on level just as the gate at Q2 is turned off. This allows no wasted time in getting the convertor back up charging C14–15 after just being discharged into the ignition coil.

The convertor output section includes rectifying, capacitor storage, and snubber circuitry 202. The diode D7 supplies DC current to capacitors C14 and C15 which are parallel connected for a 0.94 microfarad combined capacitance, a value selected for physical size, energy storage, and voltage rating. The resistors R19–21 provide a discharge path across C14, C15 when the convertor is powered off, to remove the voltage potential so the ignition may be handled safely. The snubber components D12, D13, C21, R17–18 clamp the negative secondary voltage of T1 to levels below the breakdown voltage of the diode D7 and prevent breakdown of T1 secondary insulation. The negative voltage output on the secondary winding of T1 could reach over 1000 volts if the snubber 202 were not functioning. As the negative voltage climbs above 400 volts, D13 reaches the reverse breakdown potential and current flows from the secondary through D12, D13 across C21 and R17, R18. The resistors R17, R18 discharge C21 each period that T1 primary current is flowing, so that the potential across C21 never exceeds about 500 volts. The positive current flow from T1 secondary flows through D7 and C14, C15 and D11–R28 to ground, and through the ignition coil primary when connected to C– and C+ wires.

A charge cycle of the convertor begins when the pin 1 voltage rises to about 1.2 volts. At this time, the "CONV INH" signal is low and Q8 is off, allowing the pin 1 voltage to rise across C8, which is biased by current sources internal to the control IC U1 and by TR1–R7 from the U1 4 volt reference output pin 8. The gate drive signal "IGN/TRIG" goes low about 30 microseconds after the "CONV INH" signal goes low. This allows the voltage at pin 1 to begin to ramp up before the ignition coil switch gate drive is removed (gate of Q2). The pin 1 voltage just reaches the internal threshold to set the pin 6 output latch on as the gate drive to Q2 goes low. Otherwise, the secondary current would flow to ground through Q2-collector-emitter, preventing the capacitors C14, C15 from recharging. The first output period at pin 6 is very small (only 1–3 microseconds on time) because the voltage at pin 1 is very low at start-up. This gives the convertor a soft start so the current in T1 primary is gradually ramped up over a period of about 50 microseconds to reach the full current level of operation. This presents a quieter load to the battery. As the voltage on pin 1 reaches its final value of about 2.2–2.5 volts, the convertor is operating at maximum duty cycle. At a battery input of 14 volts the duty cycle approaches about 75%, and the operating frequency is at the lowest speed, typically about 40 kHz. If the battery input lowers, the duty cycle rises because the current ramps more slowly and requires more time to reach the level required to reset the internal comparator of U1 at current sense input pin 3. The convertor may operate at about 92–94% duty cycle before the battery drops to a level where the battery compensation circuit begins to clamp pin 1 voltage lower, to lower the maximum current through T1. When the convertor has charged the capacitors C14, C15 to about 525 volts, the series Zener diode string, D14, D16, begins to conduct and current flows to bias the base of Q8 on. The transistor Q8 clamps pin 1 of U1 and pin 6 goes low to shut the convertor off. The Schottky diode connected between pin 6 and ground protect the output of U1 from negative transients generated when Q2 is rapidly turned on. As long as Q8 is on, the convertor will remain off.

At the same time that Q8 is biased on, Q9 is also biased on which occurs at a capacitor voltage just below the Q8 bias voltage. This is because the higher resistance of R32, compared to R31, both form a divider wherein, R32/R36 biases Q8 and R31/R35 biases Q9. The transistor Q9 clamps the microcontroller input "MSEN OUT" (multispark enable). When the "MSEN OUT" signal goes low, the microcontroller 302 is signalled that the convertor has reached full recharge. When the engine is operating below about 3400 RPM, the microcontroller 302 has time to "multispark," that is, spark more than once each ignition cycle. The microcontroller 302 will execute a 20 crankshaft degrees of spark duration. If the "MSEN OUT" signal has gone low and the 20-degree period has not been exceeded, then the microcontroller 302 will again provide another gate drive output to Q2, discharging the energy stored in C14, C15. At the same time, the "CONV INH" signal goes high keeping the convertor off for the coil output period. The multispark process repeats until the end of the 20-degree period.

When the 20-degree period is complete, the convertor is operated to recharge the C14, C15 capacitors and, after a limit of 3 milliseconds, "CONV INH" signal from the microcontroller 302 goes high to shut the convertor off until the next input to the microcontroller 302 signals to trigger the ignition coil again. The "MSEN OUT" signal is used to signal the microcontroller 302 that the capacitor bank has reached full charge. This signal enables the microcontroller 302 to indirectly monitor the battery level. When the battery input is above about 10.5 volts, the capacitors C14, C15 recharge in under 975 microseconds. The minimum multispark period is controlled by the microcontroller 302 at 975 microseconds and the maximum period of 1.8 milliseconds. If the "MSEN OUT" signal has not gone low at the 975 microsecond time, then the microcontroller 302 begins testing the "MSEN OUT" signal, waiting for it to go low so the output can be triggered again. The microcontroller 302 will wait in this mode up to the maximum 1.8 milliseconds and then trigger Q2 if the 20-degree window has not ended. While in this mode, the microcontroller 302 also indicates that the ignition is not reaching full recharge in the standard time (due to low battery input) and flashes an LED indicator at a 2 Hz rate, to aid in trouble shooting of the ignition, as discussed further below. This way, the user can see that the battery input is below optimum levels due to loss of battery charge or loose or corroded battery connections.

The output section of the ignition includes an IGBT ignition coil switch and gate drive circuitry. The IGBT Q2 is a fast-600 volt, 40 ampere rated IGBT. The use of an IGBT coil switch overcomes many of the limitations of prior SCR switches. The IGBT Q2 can be turned on and off very fast. The convertor may even be restarted just before the IGBT Q2 is turned off without causing extra delays due to large inductive ignition coils or failed spark gaps. When the spark fails to jump the spark gap, the primary energy circulates from C14, C15 through Q2, L2, D11-R28, and the coil primary until the energy is dissipated or Q2 is turned off. If there is still some energy in the primary when Q2 is turned off, the energy can flow back to C14, C15, partially recharging these capacitors. The capacitors C14, C15 act as a snubber for Q2 so that no over-voltage occurs across Q2. The resistor R28, parallel to D11, insures correct convertor operation when the ignition coil is not connected to the C– and C+ terminals of the ignition. The resistor R28 provides a safe ground potential for the negative terminals of capacitors C14 and C15 when no ignition coil is connected or the ignition coil primary is open circuited. With the controlled operation of the convertor, the capacitors are always properly recharged to the correct level of 525–535 volts.

The IGBT Q2 requires a gate potential of 10 VGE minimum with 15 volts desirable for full peak current capability. This is achieved easily when the battery input is above 10 volts, but requires additional voltage doubler circuitry 208 to provide the minimum gate drive below 10 volt battery input. The circuit 208 of U2, C24–26, D22–24 and R30 provides the minimum gate drive for Q2 down to an input of 5 volts battery level. At above 10 volt battery input, the Zener diode D24 clamps the input to U2, a 7660 IC for power conversion and generation using switched capacitors (C25–C26), to 10 volts, which is then doubled by the switching of capacitor C25. The resulting voltage is about 20 volt output at anode D22, "VGATE."

This voltage is connected to a level shifting circuit 210 including R22–27, C20, Q1, C16, Q12, D9–10 and Q10. The microcontroller signal "IGN/TRIG" is a 0–5 volt signal and must be capable of switching the gate of Q2 with 0–15 volt levels. The base of Q11 is driven from the microcontroller 302 from R26. The collector of Q11 pulls the base of Q12 low which forward biases Q12 and enables current flow from the "VGATE" voltage supply through Q12 emitter/collector to the anode of D10 and through R22 to the gate of Q2, which then biases Q2 on. This allows current to flow from the capacitor bank C14, C15 through the ignition coil primary connected to C– and C+ wires. The voltage at the gate of Q2 is clamped by the Zener diode D9 to 15 volts maximum. The transistor Q10 remains off at this time because it is reversed biased. At turn off of Q2, the microcontroller signal "IGN/TRIG" goes low and Q11 and Q12 are turned off. The base of Q10 is now at ground level (via R23) with the emitter at or near 15 volts. This forward biases the Q10 emitter/base junction and current flows from the gate of Q2 to ground through the emitter/collector of Q10, lowering the gate of Q2 to below 0.7 volts, effectively turning Q2 off. The diode D8 is anti-parallel to the collector/emitter of Q2. This clamps any negative voltage across Q2 to under 1 volt providing protection for Q2 and blocks any positive current flow when the capacitor bank is recharged. The diode D8 commutates any left over ignition coil energy also by directing the inductive energy to recharge the capacitors C14, C15, from C- through D8 anode to C14, C15 positive terminals.

The power supply filtering circuit 212 for the microcontroller section includes capacitors C17–19 and choke T2. These components prefilter the noise generated in the power section on the +12 voltage input to the microcontroller regulator input.

Figures 3, 3A, 3B, 3C, 3D:
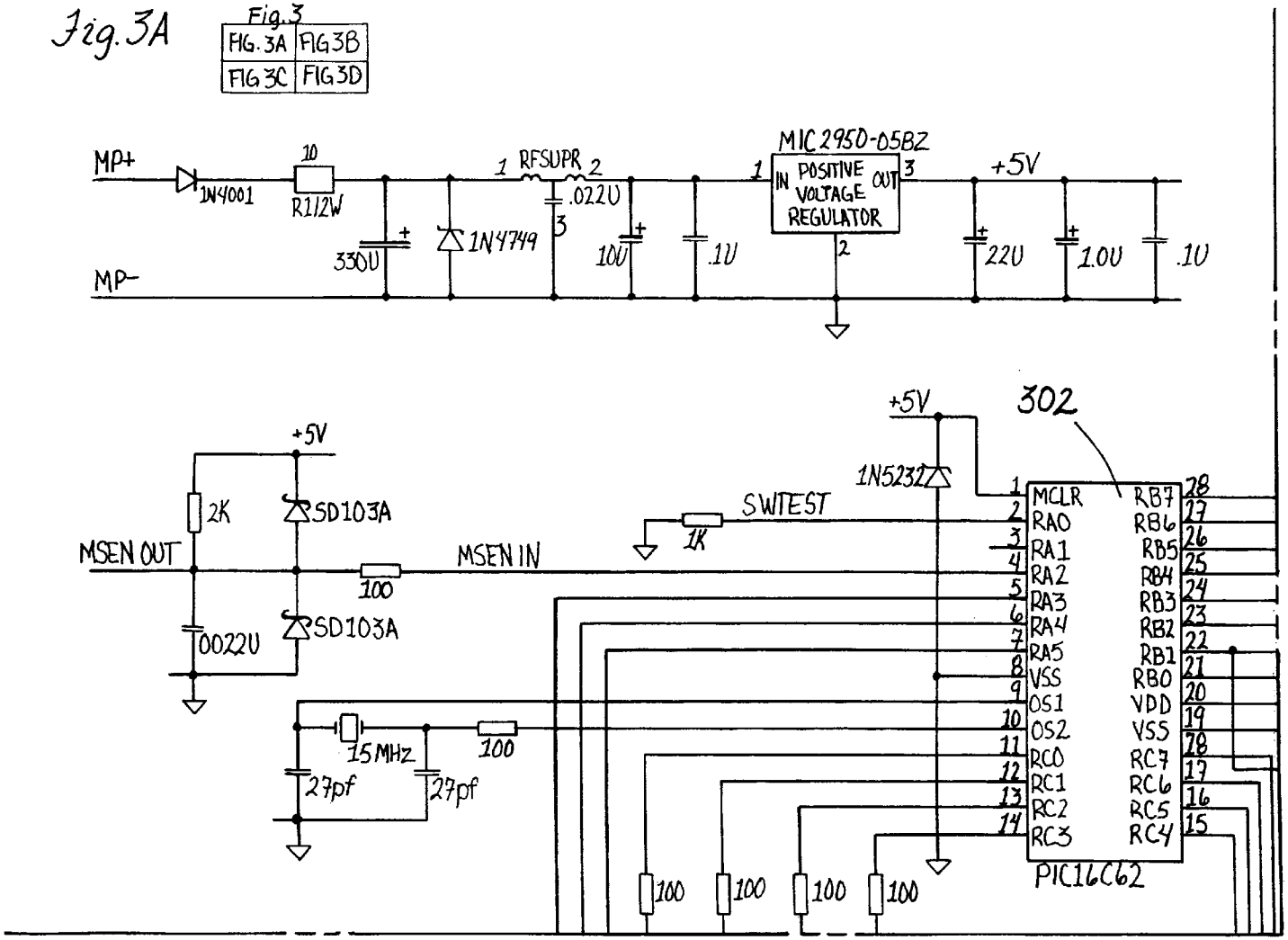
FIG. 3 is a circuit diagram of a control section of the digital ignition system of claim 1.
Figure 3B:
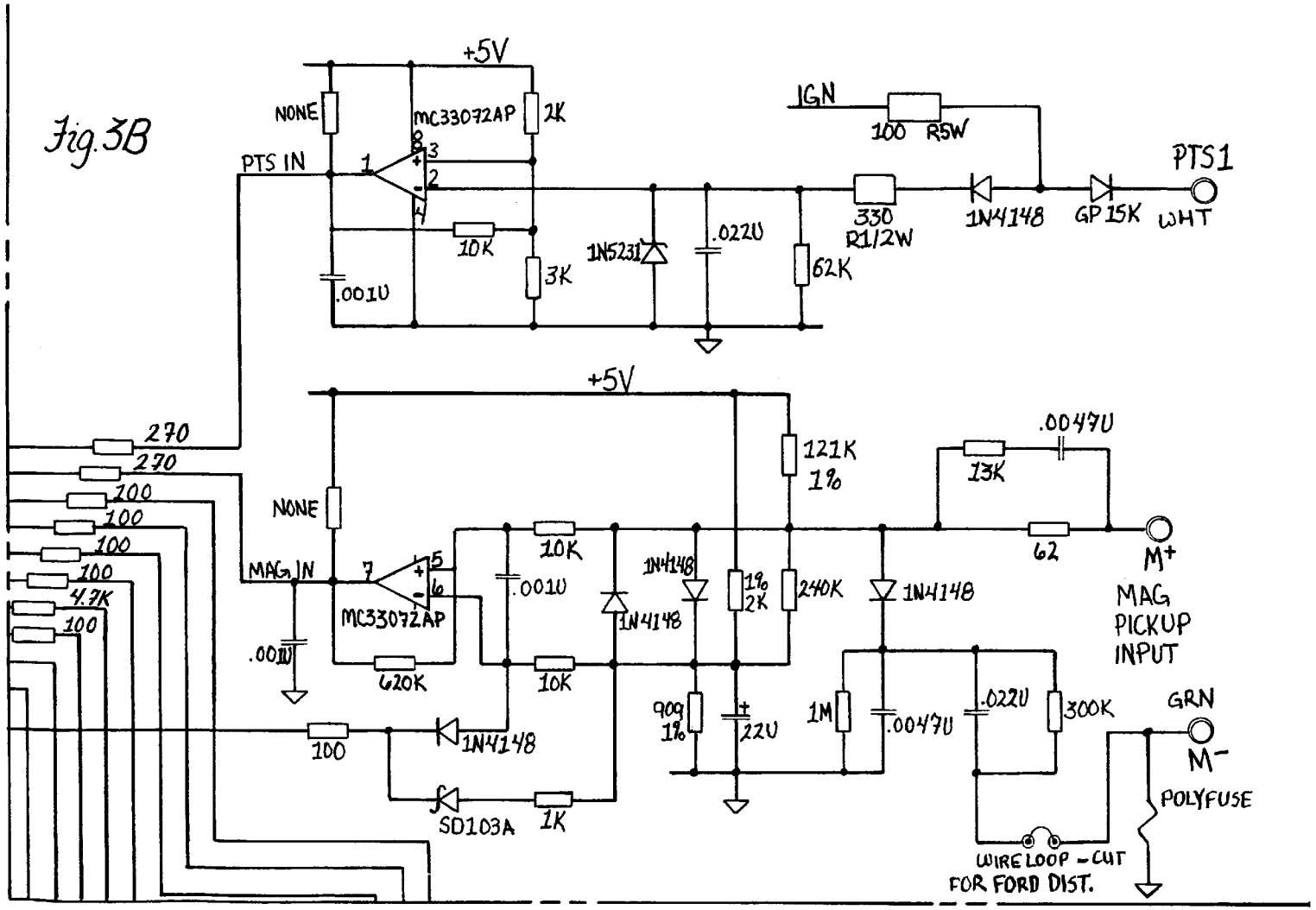
Figure 3C:
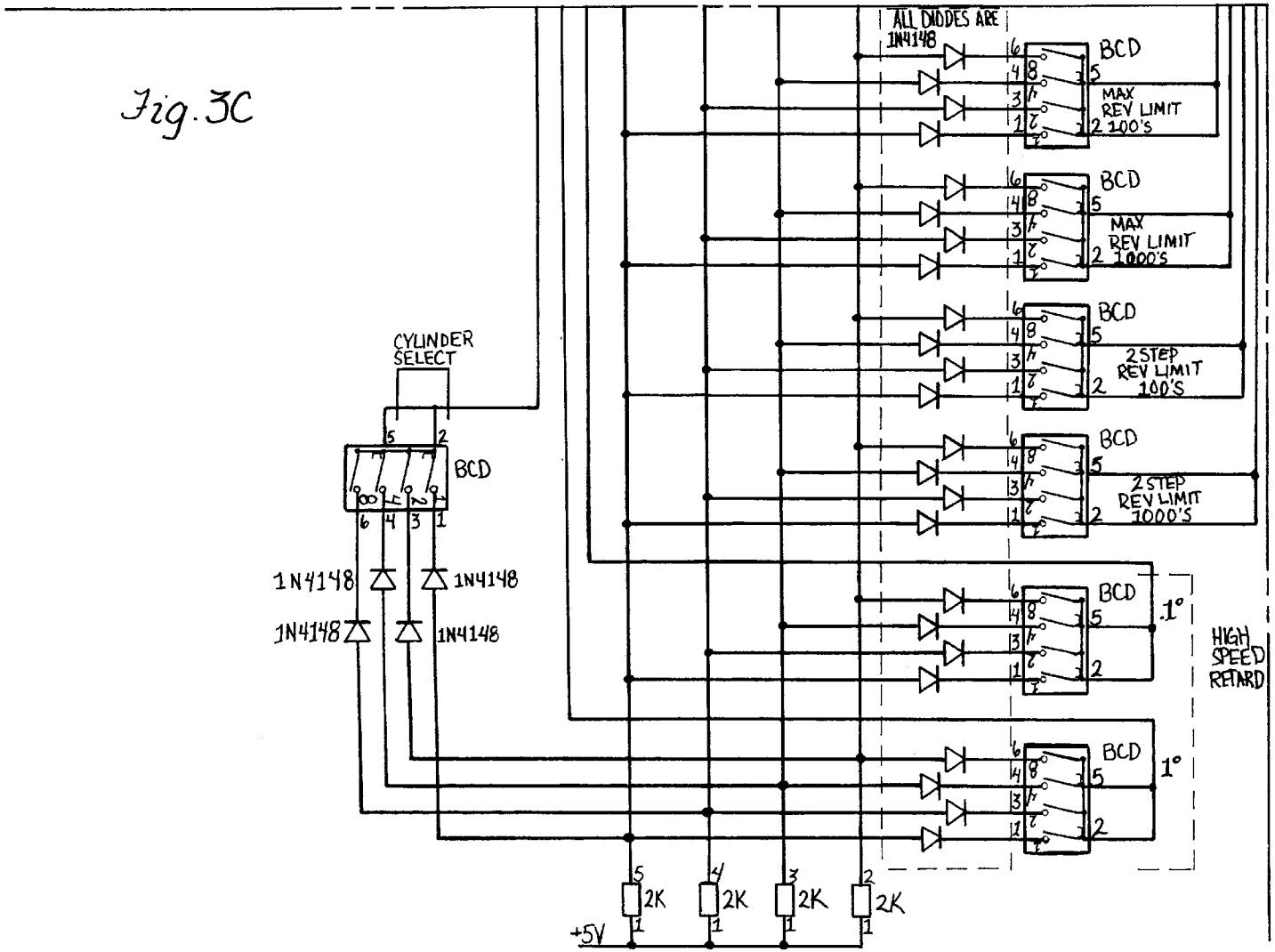
Figure 3D:
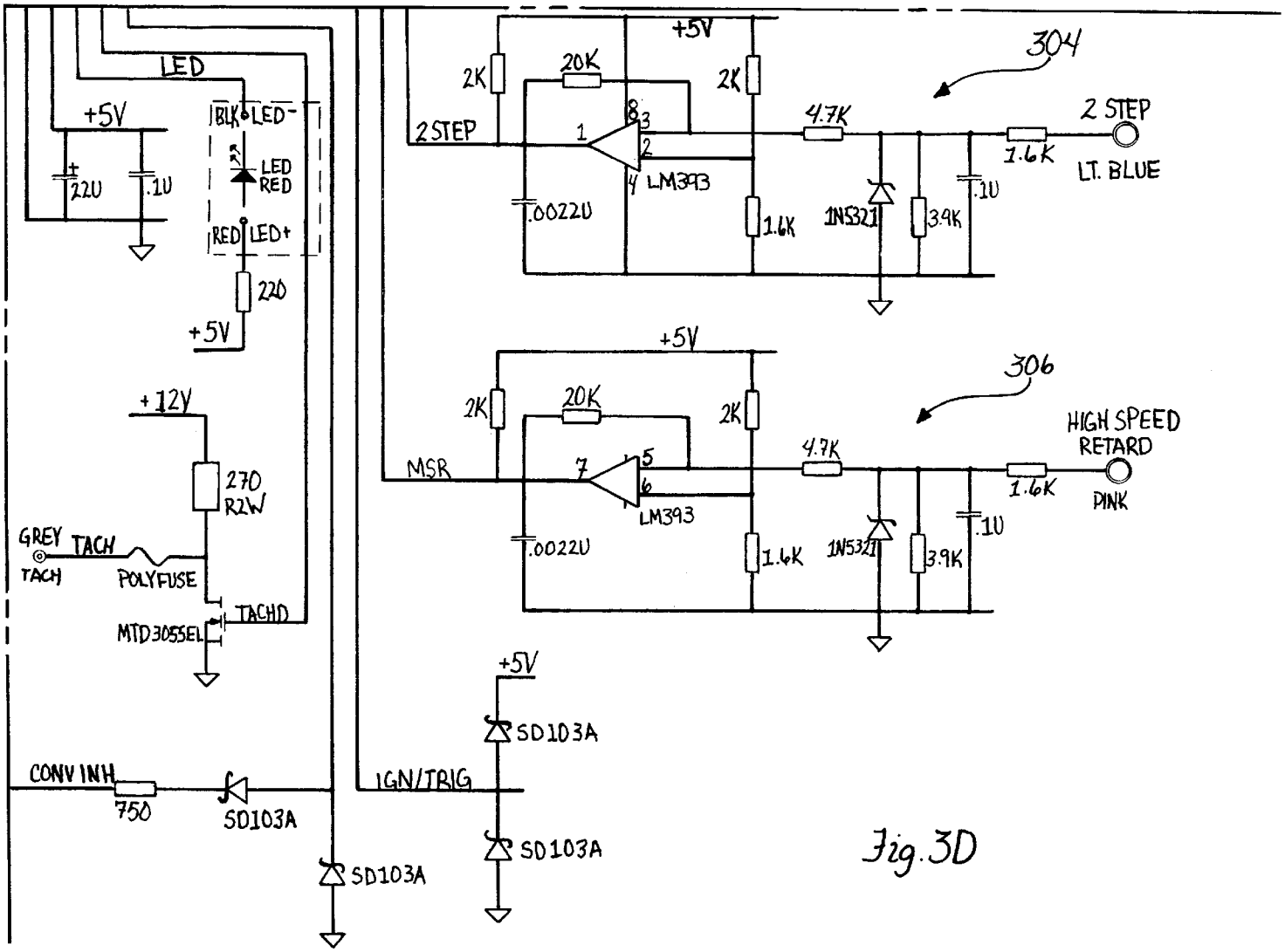
Figure 4A:
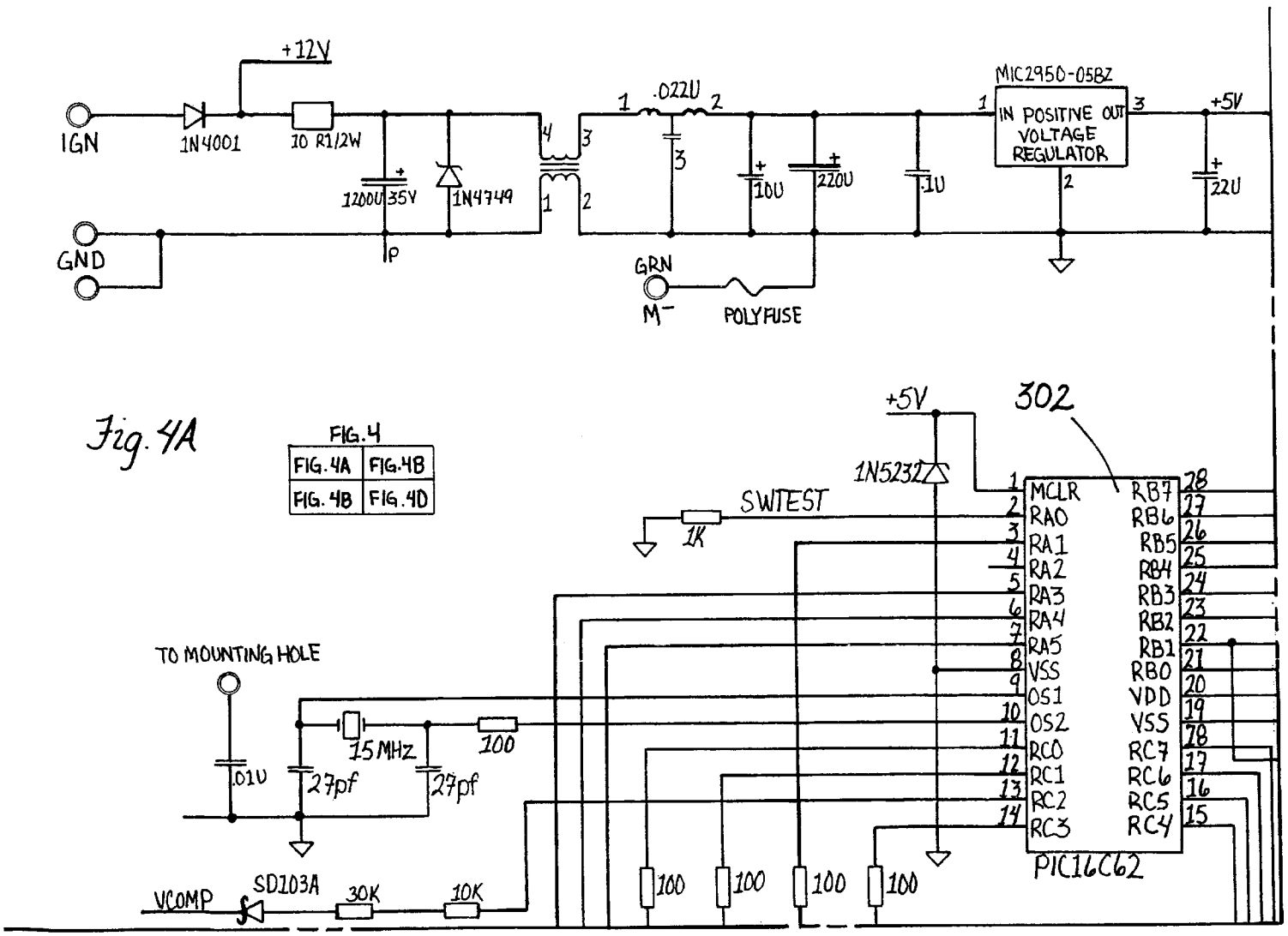
FIG. 4 is a circuit diagram of an alternate embodiment of the digital ignition system.
Figure 4B:
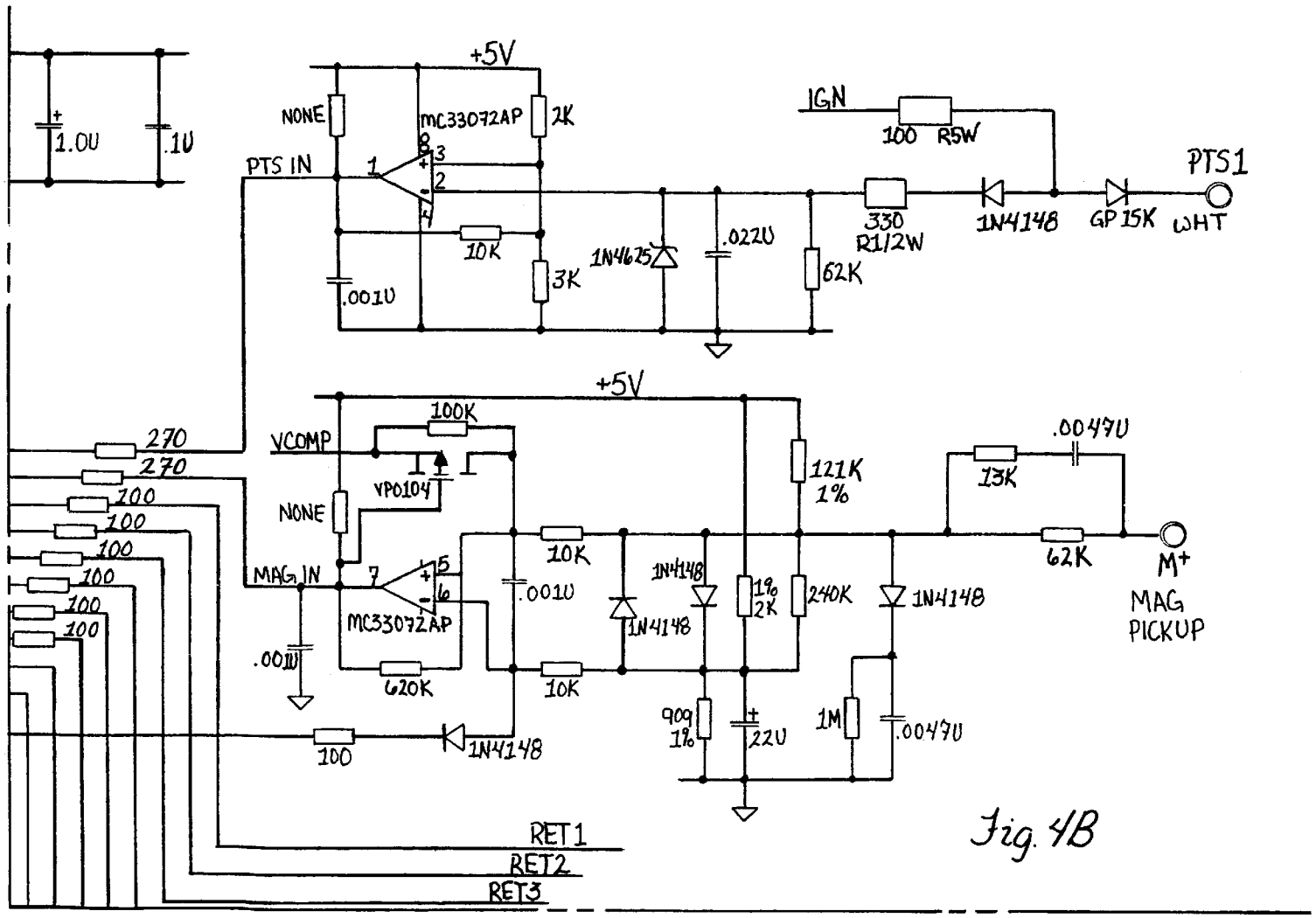
Figure 4C:
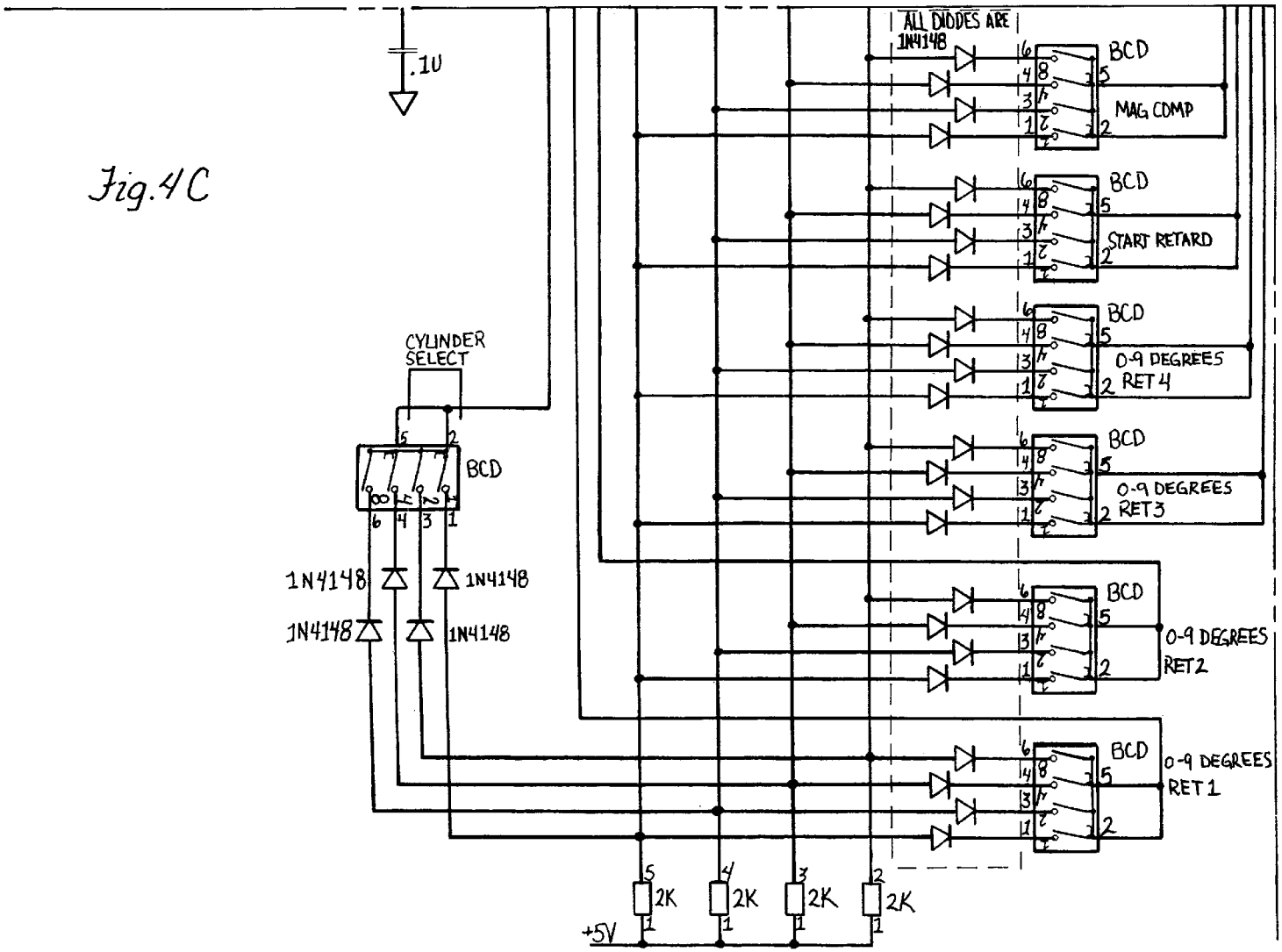
Figure 4D:
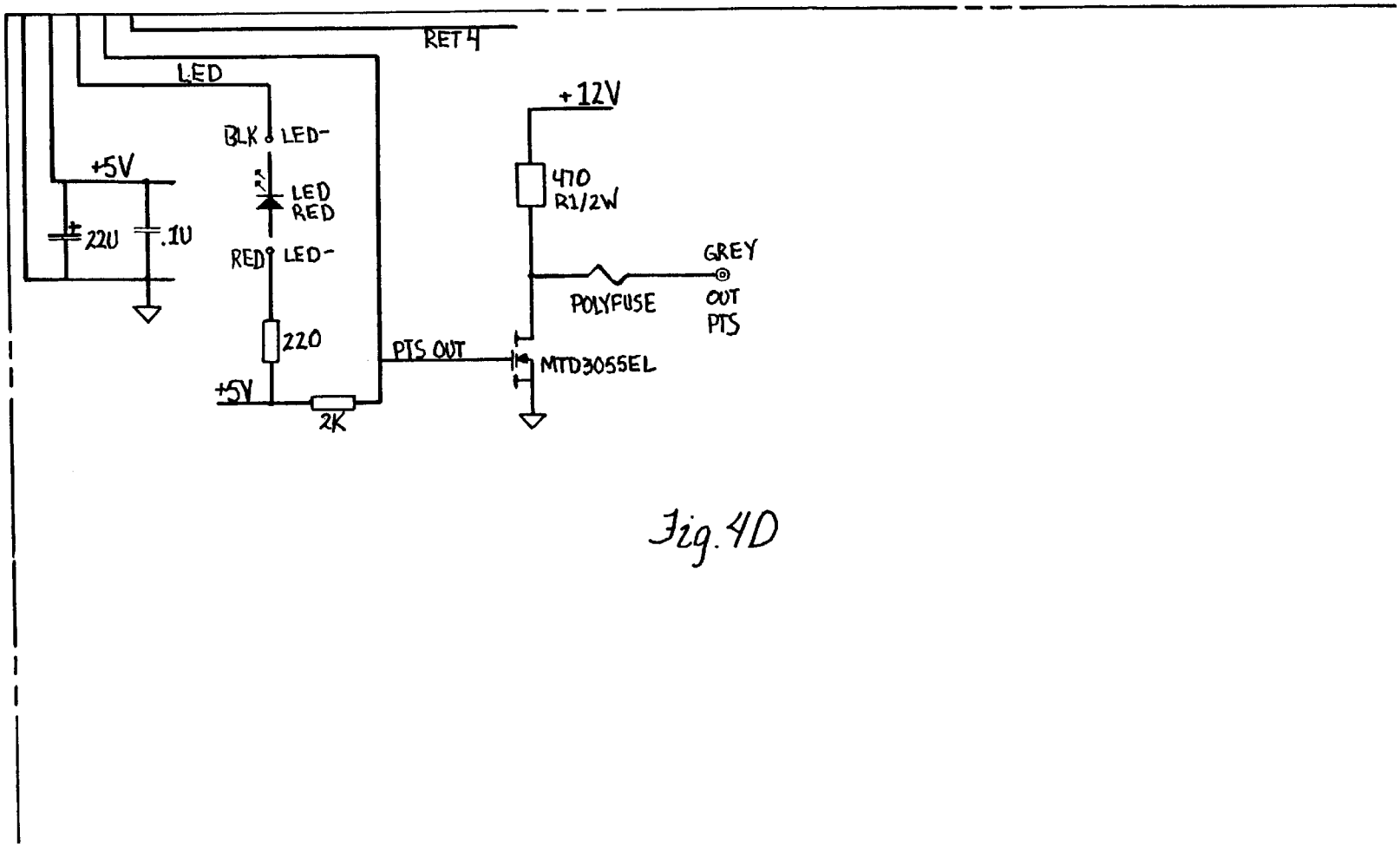

The battery input is further filtered by C29, C30, C31, F1 and reverse protected by D27 and clamped by Zener diode D28, before supplied to the input of the precision 5 volt regulator U3 (FIG. 3). The resistor R39 provides a current limiting impedance for the 24 volt Zener diode D28. The filter F1 is a high frequency inductive/capacitive filter to attenuate frequencies above 10 MHz on the input supply line. The 5 volt regulator U3 is a low dropout type with a tight +/−0.5% regulation of the 5 volt output. This insures that the microcontroller 302 is operated near the optimum supply input requirements, down to the lowest input battery level. For 5 volt output, the battery may drop to about 5.7–5.8 volt. The microcontroller 302 incorporates brown-out-detect and will reset when the 5 volt supply drops to less than 4 volts. This allows the microcontroller 302 to function down to about a 5 volt battery input level. Capacitors C32–34 and C45, C46 provide 5 volt supply filtering for the microcontroller 302. The placement of these capacitors near the microcontroller's power supply pins are important for noise immunity.

Protection components for the microcontroller 302 also include Schottky diodes D29–30, D40–43 and Zener diode D73. The Schottky diodes D40–41 and D29–30 clamp any negative or positive transients greater than +/−0.3 volt above the 5 volt supply or ground, to protect these microcontroller I/O pins. The diode D42 clamps any negative transients on pin 23 of microcontroller 302 and diode D43 blocks any positive levels or transients on pin 23. The Zener diode D73 clamps the 5 volt supply to a maximum of 5.6 volts for protection of the microcontroller 302.

The microcontroller 302 functions to accept inputs for triggering the output, to enable operation up to the preset revolution limiter values, enable timing retard, and control of the multispark operation. The inputs include PTS1, MAG PICKUP INPUT, 2 STEP, HIGH SPEED RETARD, BCD switches SW1–SW7, SWTEST, and MSEN-IN. The outputs include TACHD, CONV INH, IGN/TRIG, and LED: Seven I/O's are used for switch select.

The ignition is user programmable and includes programmable features such as max speed rev limit, 2 step rev limit, high speed retard cylinder select and start retard (20 degrees), as described further below. In particular, the ignition may be programmed by setting of the SW1–SW7 BCD switches to the desired function.

Note that the BCD switches may be 2 decade-10 position BCD type sealed Grayhill rotary screwdriver adjustable type switches. The switches SW1–2 set the maximum rev limit over a range of 2,000 RPM minimum to 12,500 RPM maximum. The switch pair can select the RPM limit in 100 RPM increments from 2,000 RPM to 9,900 RPM. When the switches SW1–2 are both set to 0,0, the maximum rev limit is set for 12,500 RPM. This gives the user the option to use an external revlimiter from 9,900 RPM to 12,500 RPM. Switch SW1–2 values above zero and less than 2,000 RPM will default to a value of 2,000 RPM.

SW3–4 are used to set the 2-STEP reviimit value, from 2,000 to 9,900 RPM in 100 RPM increments. When this pair is set to any value below 2,000 RPM, the default rev limit is 2,000 RPM. The 2-STEP revlimit is activated when the input 2-STEP is pulled high to +12 volt (or any battery potential above 4.5 volt). This input is debounced in the microcontroller 302 to insure clean revlimiter selection and reject any noise that may be seen by the microcontroller at this input pin.

The HIGH SPEED RETARD input selects the retard switches SW5–6 value to retard the ignition spark output when this input is pulled high (above 4.5 volt). Like the 2-STEP input, this input is also debounced by the microcontroller 302 to insure proper selection of this function and rejection of noise. For the RETARD function to be completely enabled, the engine must be operating above 2,000 RPM with the HIGH SPEED RETARD input pulled high. The BCD switches SW5–6 select the retard value from 0 degrees to 9.9 degrees in 0.1 degree increments. The SW7 selects the engine type for the microcontroller, with engine selections of 4, 6 and 8 cylinder even fire and 6 cylinder odd fire (90–150 degree) engine types. Positions 0–3 select cylinder counts of 4, 6, 8 and 6 odd, also, positions 4–7 select these same cylinder counts with 20 degrees start retard enabled. Below 500 rpm, 20 degrees ignition timing retard is selected up to 800 rpm when timing is returned to full timing. The rpm must drop back below 500 rpm to reactivate the 20 degree retard feature. Also, when the retard is active, the multispark is decreased to 10 degrees wide to help prevent crossfire in the distributor cap.

The BCD switches SW1–SW7 are read by the microcontroller 302 at power up and SW1–SW6 can be read while the engine is operating. According to one embodiment, the switch SW7 can only be read at power up so the operator cannot accidentally select the wrong engine type while the engine is running. The microcontroller 302 scans each switch (SW1–SW7) by pulling the switch select line low; such as pins 15–18 for SW1–4 and pins 5–7 for SW5–7. The switch data is then input on a common 4 pin bus, pins 11–14, after the switch select pin has gone low to select only one switch at a time.

The 2-STEP and HIGH SPEED RETARD input circuits 304, 306 are identical in component layout and operation. The 2-STEP input circuit 304 includes components R61–R66, R89, D38, C47–48, comparator U5A, and in one embodiment half of a LM393 bipolar voltage comparator IC. The inverting input at pin 2 is biased at 2.2 volts by R63/R65 divider pair from the 5 volt supply. The resistor R61 provides a pull up of the output pin 1 to the 5 volt supply and R62 provides positive feedback to the input pin 3. The input to pin 3 includes a divider pair R66/R89, that divides the input to ½ of the input terminal voltage. The diode D38 clamps the maximum input the input resistor R64 on pin 3 to 5 volts, providing overdrive protection for the IC U5. When the input at the non-inverting input, pin 3, exceeds 2.2 volts, then the output pin 1 goes high to 5 volt, driving pin 26 of microcontroller 302 high, only while the microcontroller 302 is scanning the 2-STEP input pin. The hysteresis action from the feedback resistor R62 helps to sharpen the switching edges at the switching thresholds of the input signal and also helps to reduce bouncing of the output due to noise on the input pin. The capacitor C47 helps to filter some of the high frequency noise at the microcontroller input pin and only delays the rise time at pin 1 by about 4 microseconds.

The PTSI input circuit also uses a voltage comparator, U4A (half of U4), such as a MC33072 op amp, to sense the input trigger from the engine points signal, which could be mechanical points, or the ECU coil driver. The PTSI input circuit includes components R43–49, D31-33, and C39–40. R49 provides a pull-up current source of about 140 milliamperes at 14 volt battery. This results in the input level equal to the battery potential from the PTSI driver (engine/ECU signal) at anode of D32–33. This signal is then directed to the input pin 2 of U4 by R48, current limiting resistor, and clamped to 5.1 volt maximum by Zener diode D31. The capacitor C40 provides input debounce on the leading edge of the PTSI signal (FIG. 11) and a large amount of debounce on the trailing edge. When the PTSI signal goes high (trigger edge), C40 quickly charges to above 3 volts threshold through R48, to switch the output at pin 1 low. This occurs in about 2 microseconds, so the delay from input to ignition output is held to a minimum. When the PTSI signal goes low, C40 begins discharging through R47, a large resistor, and takes at least 650 microseconds before the input at pin 2 falls below the 3V volt threshold at pin 3. This provides a long enough debounce period for most mechanical ignition breaker points so that false triggering of the ignition is not possible. Also, the microcontroller 302 has debounce which is very small on the trigger edge and quite large on the trailing edge to reject any bounce that may get through the hardware debounce. The microcontroller also inhibits all inputs after a valid trigger edge input for greater than 30 degrees to reject any noise during the spark output time period.

The microcontroller 302 has two inputs from which the ignition may trigger: PTSI and MAG PICKUP/CRANK TRIGGER input. Only one of these two inputs is allowed to be the trigger input. In particular, the only signal that can interrupt the microcontroller 302 is either the PTSI input or MAG PICKUP/CRANK TRIGGER input. It is to be noted that the system may use an adaptive debounce technique for enabling the debounce time on the trailing edge to be reduced from a predetermined maximum time to lesser times as engine speed increases. For example, each time the interrupt routine is executed, a timer may be used to measure the amount of time taken by the trailing edge debounce function. Accordingly, as the engine speed increases, the debounce time can be lessened during subsequent executions of the interrupt routine. Thus, excess debounce delays may be eliminated so that the leading edge may be serviced more quickly.

Figure 11:
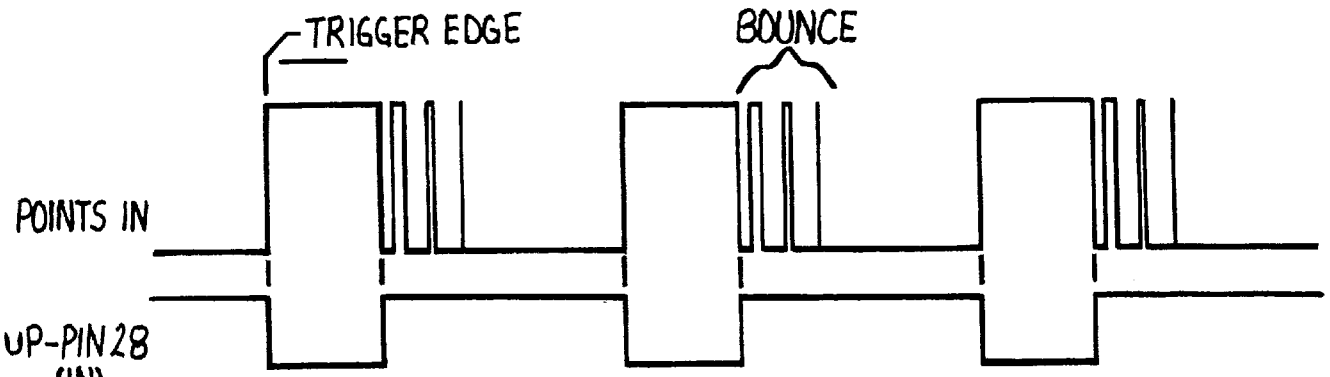
FIG. 11 is a timing diagram for the PTS1 signal.
Figure 13:
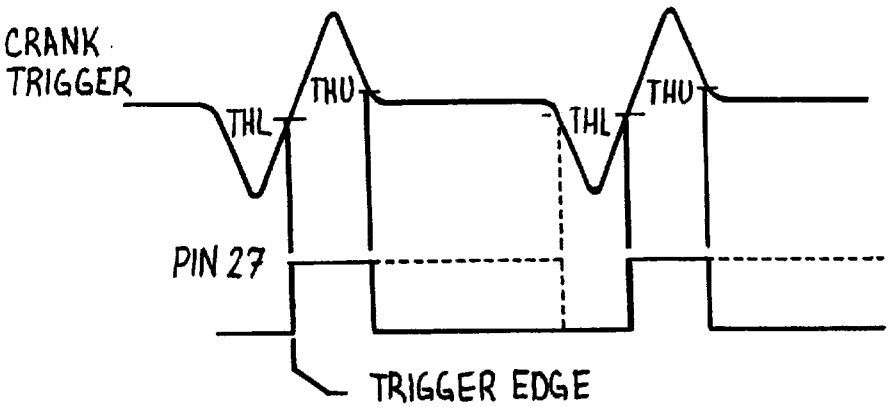
FIG. 13 is a timing diagram for the crank trigger signal.
Figure 12:
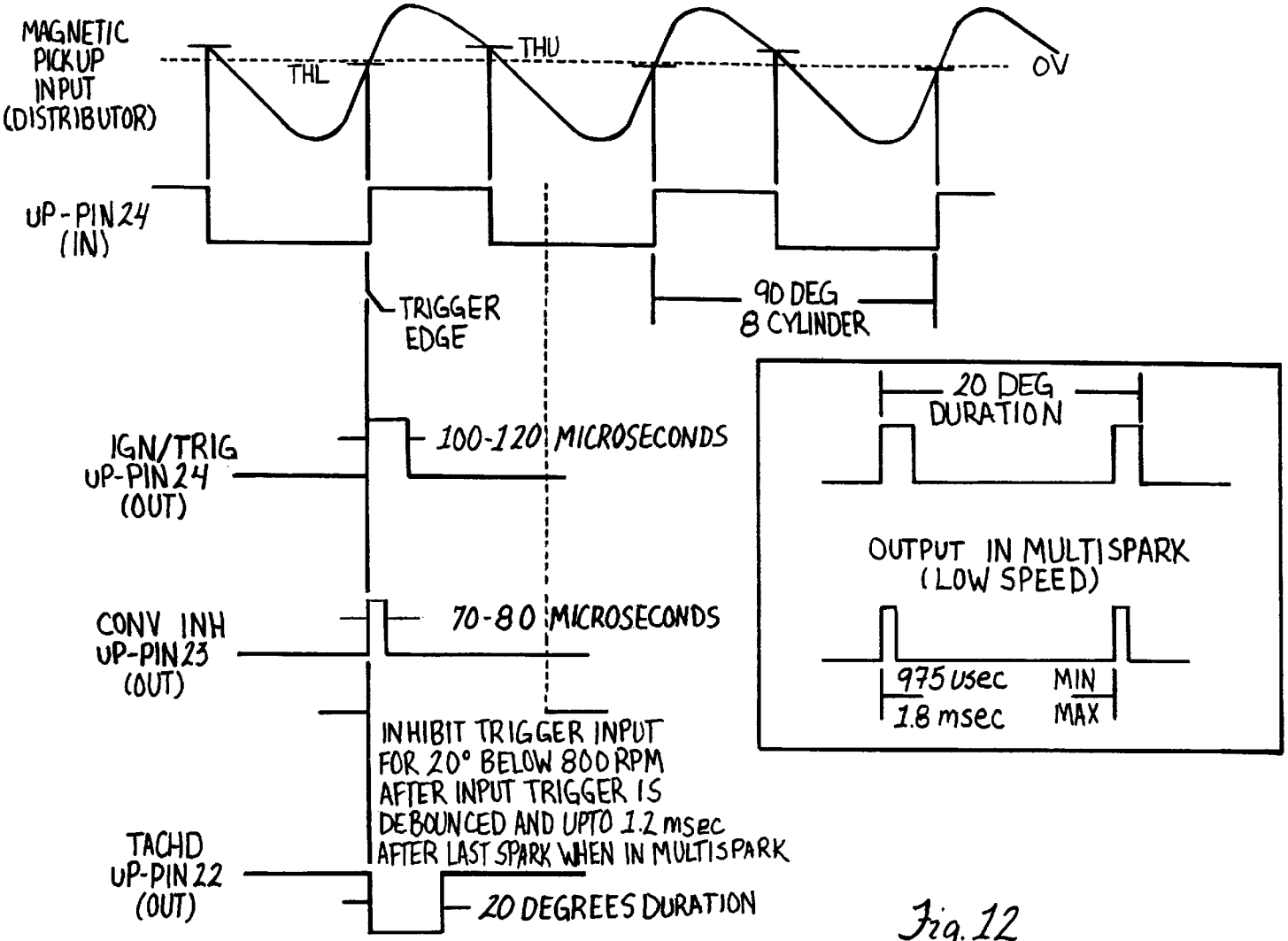
FIG. 12 is a timing diagram for the magnetic pickup input.

At power up, the microcontroller decides which of these inputs has the trigger signal and only that input is selected for the ignition trigger input. The microcontroller 302 makes the other input an output so that the non-input signal is ignored and cannot interfere with the input signal. Therefore, the microcontroller 302 operates with only one interrupt. In particular, as shown in FIGS. 11–13 an interrupt may be generated on the leading edge of the PTSI input (FIG. 11), the leading edge of the MAG PICKUP input (FIG. 12) or the leading edge of the crank trigger (FIG. 13). The other inputs, 2-STEP and HIGH SPEED RETARD, are scanned in between ignition output cycles.

The MAG PICKUP INPUT is also based on a bipolar op amp, such as the MC33072, as a voltage comparator U4B. The use of an op amp like the MC33072 has several advantages over CMOS type comparators and bipolar comparators like the LM393. Voltage comparators have extremely high gain which make them inherently subject to bounce from noise. Furthermore, CMOS voltage comparators can experience lock up due to high Dv/Dt noise on supply pins or input pins. The MC33072 bipolar op amp used in the present invention is relatively immune to high Dv/Dt noise on ground and supply input pins. In addition, the bipolar op amp is generally faster than most other op amps above 2.4 volts per microsecond.

This circuit includes components R50–60, R92, D34–35, D74, D76, C41–44, and the other half of U4. The input is normally connected to a magnetic pickup, such as found on a MSD, Ford or GM ignition distributor. The pickup signal is a near sinusoidal type that has very low amplitude at engine cranking speeds and very high amplitudes at maximum engine speeds. The desired switching point is near the zero crossing of the mag input signal and must be compensated to null the inductive retarding effects of the magnetic pickup. The circuit designed to do this function performs all of these features with a very sensitive input at cranking speeds with +/−0.6 volt minimum input and the switch point compensated for high speed and high amplitude, triggering up to 30 volts before zero crossing to null the pickup retard. By proper compensation, the noise immunity is also increased as the mag signal gains amplitude. In particular, as further described below, a feedback circuit is included for automatically enabling noise rejection at the mag input at increasing speeds. The input must also be protected from overdrive due to the large pickup voltage potential at high speeds. The mag input circuit can be easily modified for almost any type of magnetic pickup available by only changing a single resistor the compensation value can be set to give zero degree retard or advance at maximum speed.

The feedback circuit includes the components C42, R95, R100 and D75–D76. C42 provides a predetermined time constant via R52. C42 is discharged via R100, which is in series with D76, by pin 22 of the microcontroller 302 going low. The pin 22 goes low (FIG. 11) at detecting of the mag input leading edge signal present at pin 27 of the microcontroller 302. Accordingly, the feedback function clamps the negative input of the voltage comparator, pin 6 of U4 to a low voltage value, typically about 0.7–0.9 volts above ground and to discharge C42 to the lower level as well. The input pin is quickly lowered to the lower voltage level and the capacitor C42 is clamped to this lower level after about 22 milliseconds. This allows the common mode voltage to reach the greatest difference in potential across the voltage comparator inputs, limited to approximately 0.7 volts by diodes D34 and D35. While the pin 22 of the microcontroller is low this difference is even greater because the voltage comparator negative input is clamped closer to ground via D75 and R95. The microcontroller pin stays low for 20 to 30 crankshaft degrees typically. When this pin goes high the feedback is removed from the voltage comparator and the capacitor C42 begins charging back to its higher voltage level, typically about 1.5 volts. At low engine speeds this capacitor reaches near its full potential and the common voltage across the comparator inputs is very close, typically about 80 to 100 millivolts. This keeps the start up sensitivity of the mag input circuit correct for very low peak-peak mag input levels, but as the speed increases the capacitor C42 never reaches the full charge potential and this develops a larger difference voltage across the inputs of the voltage comparator, which increases the noise immunity of the mag input circuit further as the speed increases. This automatically provides a self-compensating means of rejecting noise at the mag input which increases the ability to reject higher noise levels as the engine speed increases.

Pin 6 is clamped by back-to-back diodes D34–D35 for +/−0.7 volts maximum differential and the input pins 5 and 6 are offset from ground at about 1.56 volts at pin 6, the inverting input. The non-inverting input is biased at about 1.64 volt so that there exists an off-state voltage difference of about 80 millivolts across the voltage comparator inputs. The comparator would have an output of high, near 5 volts in this state. The series resistor string of R55, R54, are paralleled by R52 to bias the inverting input pin 6 at R51 to about 1.56 volt. Also, the pickup winding parallels R54, R51 through R60. By biasing the inputs above ground by about 1.5 volt, the comparator input is never pulled below ground and still allows the comparator to be powered from only a 5 volt supply.

The input components C43, D74, and R92 supply slope compensation to the input. The capacitor C43 will shunt R58 via D74 on the positive slope of the mag signal input. This provides a higher gain on the positive going portion of the mag input signal which counters the retard of the mag signal. But the same gain is not desirable for the negative going portion of the input signal. The diode blocks the negative and decreases the gain by having R92 resistor in series with the capacitor C43. This allows the negative slope compensation to be about ¼ of the positive slope compensation and prevents over-driving of the comparator inputs, which may be caused by extreme rates of negative mag input signal or noise on the mag input signal. A wire loop is provided between the negative mag input M− and C56, R94 to select the optimum mag compensation. In particular, the wire loop may be cut to comply with requirements of various manufacturers.

The microcontroller output IGN/TRIG is the ignition output drive signal that is level shifted to drive Q2, the ignition coil IGBT switch. According to one embodiment, this output may be about 105 microseconds in duration to drive Q2. This value was chosen because with a large inductive ignition coil the current rise time is limited by the inductance and has been found to need at least 80–90 microseconds to completely discharge the fully charged C14, C15 capacitor bank into the ignition coil primary.

The multispark period is controlled by the microcontroller 302 and is normally about 975 microseconds at battery input above 12 volts. The multispark period is increased if the capacitor bank C14, C15 has not reached full charge in 975 microseconds and can be delayed up to 1.8 milliseconds maximum if needed. This way every spark output is full amplitude (525–535 volts), until the battery drops below about 6.5 volts when the 1.8 millisecond limit is reached.

The CONV INH is used to shut the convertor off while the IGBT Q2 is turned on. These signals overlap so that the convertor can be ready for output within microseconds of the IGN/TRIG signal going low. This improves the time between capacitor discharge and recharge, so that very little time is wasted.

The LED output is used for several modes of operation. The first is to turn the LED on (output low) when the PTSI signal goes high (trigger edge) to indicate static timing or points signal present. Also, when the mag signal is present, the LED will blink, indicating that the mag signal is present and OK. The LED blinks at a 2 Hz rate when the capacitor bank C14, C15 is taking longer than the normal 975 microseconds to recharge during multispark operation. The last mode of operation is for the switch test mode. When the switches are all set to the zero position and the input pin 2 of the microcontroller 302 is pulled high at power up, the microcontroller 302 enters a switch test mode. The LED blinks once every 3 seconds until the switches are rotated or fail mode is indicated. Normal switch test sequence begins by applying power and the LED blinks. Then, beginning with SW1, it is rotated from zero position completely around back to the zero position. The LED blinks twice quickly indicating OK, then the next switch is rotated, with the LED blinking the OK double blink after each good switch. When the last switch is rotated back to the beginning position, the LED blinks then stays on, indicating the end of switch test-OK. If any of the switch tests fail, the LED immediately begins blinking at a 1 hz rate until the power is turned off. The switch test must be restarted if a failure occurs. This allows rapid testing of every switch position and easy identification of a bad switch. The TACH output drives the Q14 gate which provides a 30-degree, 12 volt (battery) amplitude at the TACH terminal pulled up by R73. The microcontroller 302 generates the tachometer drive signal whose period indicates the inhibit period of the trigger input. This output is used by external devices such as RPM activated switches and for a tachometer drive signal. The TACH output terminal is protected against shorts to the battery by the self-resetting polyfuse F2.

Referring to FIGS. 6A, 6B, the system is shown in operation. In particular, upon startup, the system undergoes an initialization procedure in step 296. During this time, timers and I/O pins are set up, external switches are read, rev limit values are calculated and interrupts are enabled. The interrupt enable is responsive to either the points input or the mag input, as mentioned above. The system in step 298 enters a main loop wherein the watchdog timer is cleared, the timer overflow is saved, the system checks for dead channels, turns off the convertor after 3 milliseconds of operation, flashes an LED during convertor error and reads external switches. Step 298 loops until an interrupt is received.

Upon interrupt, in step 300, the degree delay is copied into the degree timer and the revolution timer is read. In step 302, the system determines whether a leading edge was detected (FIG. 12) the input that has 2 edges sensed is selected as the interrupt input and the other input is unselected and made an I/O-output (Note: only one input is used for the trigger source). If a leading edge was detected, then in step 304 the tach output and the LED output is turned on. The system determines whether a degree delay timeout occurred. If not, the system returns to step 306. However, if a degree delay timeout is determined to be present, then the system, in step 308, executes a spark output routine by calculating the time of one revolution and calculating the time of a 20 degree window at which the crankshaft is turning and then enables a spark to be produced. In step 310, the system determines whether the spark interval timed out. If so, then in step 312, the spark output routine is once again then executed. If in step 310, the spark interval did not time out and upon execution of the spark output routine in step 312, the system determines whether the 20 degree window timeout has occurred. If not, the system returns to step 310. If so, then in step 316 the system calculates the degree delay, calculates the rev limit values, turns off the tach output, turns off the LED output, copies timer to dead time and reads the two step input. In step 318, the system checks for a trailing edge and performs debounce, and returns from the interrupt entry back to the main program.

Referring to FIG. 4, a second embodiment of the present invention is shown that provides greater noise immunity and further reduces retarded ignition timing due to the inductive lag properties of most magnetic pickups. Note that in this embodiment, many of the previously described features of the prior embodiment are retained, including the start retard feature. The power section 104 of the previously described embodiment may generally be omitted to realize manufacturing cost savings.

As can be seen in the figure, the microcontroller pins 3 and 13 have been swapped in the present embodiment compared to the earlier described embodiment. The present embodiment of the invention uses the microcontroller's internal PWM (pulse width modulation) module to generate a PWM signal present on pin 13 of the microcontroller 302. This signal is filtered by R3 and C9 and is connected to the positive input pin of the voltage comparator pin 5 of U4 via R4, D1, Q15 and R2. The action of R4 and R2 set the maximum gain of this filtered feedback compensating voltage when the voltage comparator output pin 7 is high. When the mag input signal causes the voltage comparator output pin 7 to go low, Q15 is forward biased and effectively shorts R2, providing a low impedance path from D1 to the comparator input pin 5. This action of Q15 changes the feedback gain from low while the comparator output is high to a much higher feedback level when the comparator goes low. Q15 is required because the very high level of feedback used causes a shift in the input negative threshold of comparator U4.

With the action of Q15–R2 the gain of the feedback is such that the negative going threshold feedback is reduced for correct noise immunity and the feedback is then allowed to be increased substantially for the positive mag input threshold. The positive mag threshold must be controlled very accurately to null the retarding effects of the magnetic pickup and circuitry. This is controlled by the PWM module of the microcontroller 302, which generates a duty cycle that is proportional to speed. The user can select a feedback value which is designated as Mag Comp, a 10 position rotary switch sets the gain of the PWM output, which results in a voltage that is proportional to engine speed to be added to the positive input of the mag input voltage comparator.

Resistor R4 sets the maximum feedback gain for the positive mag threshold. The time constant of the feedback voltage was selected to be about 1 millisecond, this allows the feedback voltage to track the current engine speed with almost no lag, which could cause a timing error if the filter time constant were too slow. The frequency of the PWM signal was chosen to present a very low amount of ripple content on the feedback voltage to the voltage comparator and still have fast response to engine speed changes. The noise immunity with this feedback method provides significantly enhanced noise immunity over previous mag input circuit designs.

An advantage of the present embodiment is the ability to debounce the trailing edge of the input signal in proportion to the engine speed. In particular, because signal noise is greater during lower engine RPMs, but decreases as the engine speed increases, debounce time should preferably be decreased as engine speed increases. In addition, decreasing the debounce time is advantageous because the leading edge of the input signal may be received even before the trailing edge has completed debouncing. A proportional type debouncing system provides a greater amount of noise prevention than has heretofore been available and also provides solid, stable triggering.

In particular, debouncing of the trailing edge signal may be accomplished by assigning predetermined debounce durations to various predetermined RPM ranges. For example, the present invention may assign six different debounce durations to six different RPM levels. In particular, a debounce duration of 1440 microseconds debounce may be assigned to engine speed less than 200 RPM. Similarly, 720 microseconds debounce may correspond to engine speeds of 200 to 500 RPM, 360 microseconds may correpond to 500 to 800 RPM, 180 microseconds may correspond to 800–3500 RPM, 45 microseconds may correspond to 3500–8000 RPM and 22 microseconds may correspond to 800 or greater RPM. It is to be understood that the number of ranges and their corresponding debounce durations may be varied. Furthermore, the present system may be used in any input circuit to clean up trigger signals and in particular may be used in any ignition front end between the trigger and the ignition input.

Figure 5:
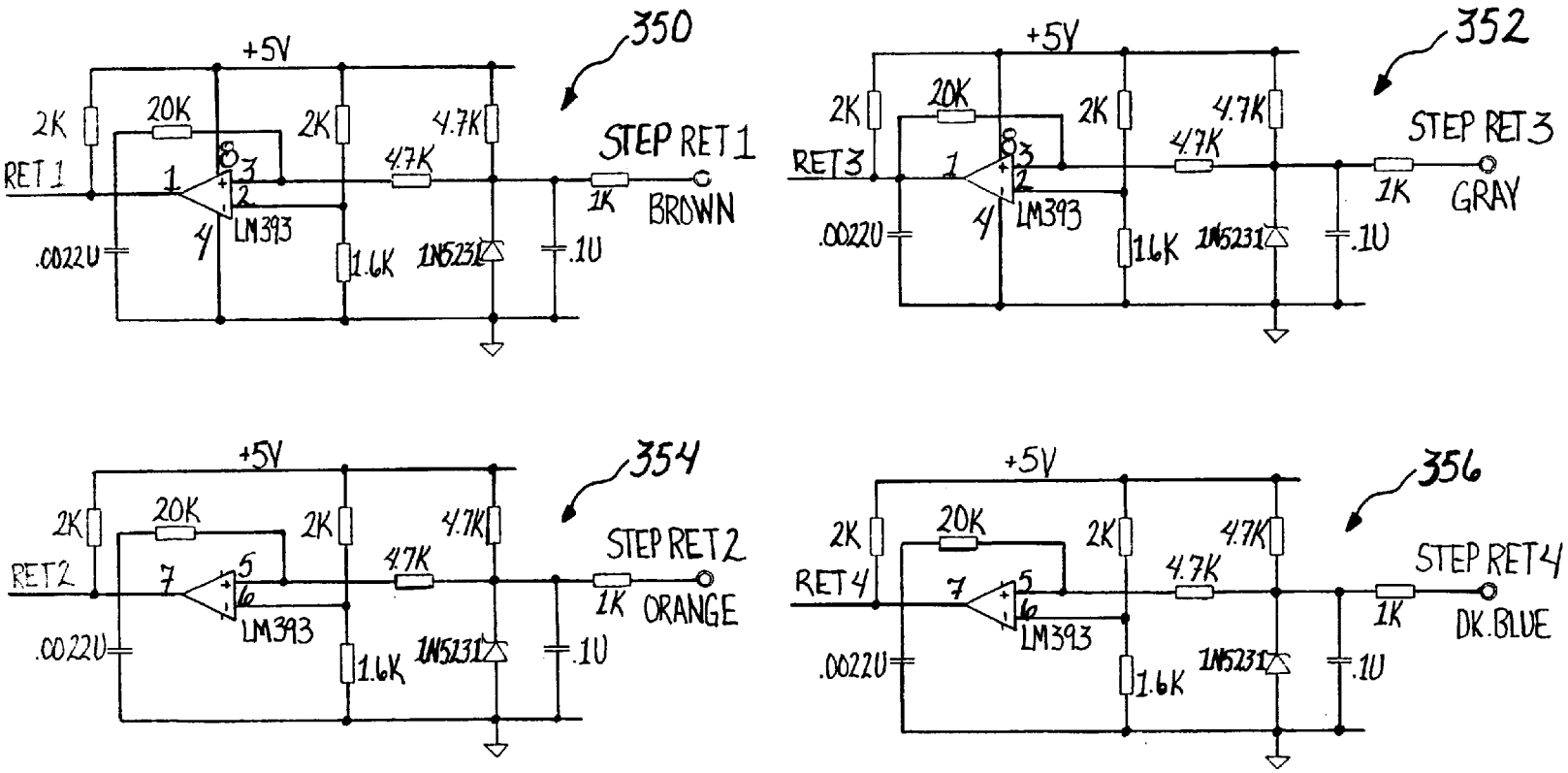
FIGS. 5A–5D are circuit diagrams of step retards of the digital ignition system of FIG. 4.

The STEP RETARDS 1–4 input circuits 350, 352, 354, 356 (FIG. 5) are identical in component layout and operation. The STEP RETARD 1 input circuit 350 includes components R61–R66, R21, D38, C47–48, comparator U5A, and in one embodiment half of a LM393 bipolar voltage comparator IC. The inverting input at pin 2 is biased at 2.2 volts by R63/R65 divider pair from the 5 volt supply. The resistor R61 provides a pull up of the output pin 1 to the 5 volt supply and R62 provides positive feedback to the input pin 3. The input to pin 3 includes a divider pair R66/R89, that divides the input to ½ of the input terminal voltage. The diode D38 clamps the maximum voltage at the input resistor R64 on pin 3 to 5 volts, providing overdrive protection for the IC U5. When the input at the non-inverting input, pin 3, exceeds 2.2 volts, then the output pin 1 goes high to 5 volt, driving pin 26 of microcontroller 302 high, only while the microcontroller 302 is scanning the STEP RETARD 1 input pin. The hysteresis action from the feedback resistor R62 helps to sharpen the switching edges at the switching thresholds of the input signal and also helps to reduce bouncing of the output due to noise on the input pin. The capacitor C47 helps to filter some of the high frequency noise at the microcontroller input pin and only delays the rise time at pin 1 by about 4 microseconds.

Figures 7A, 7B:
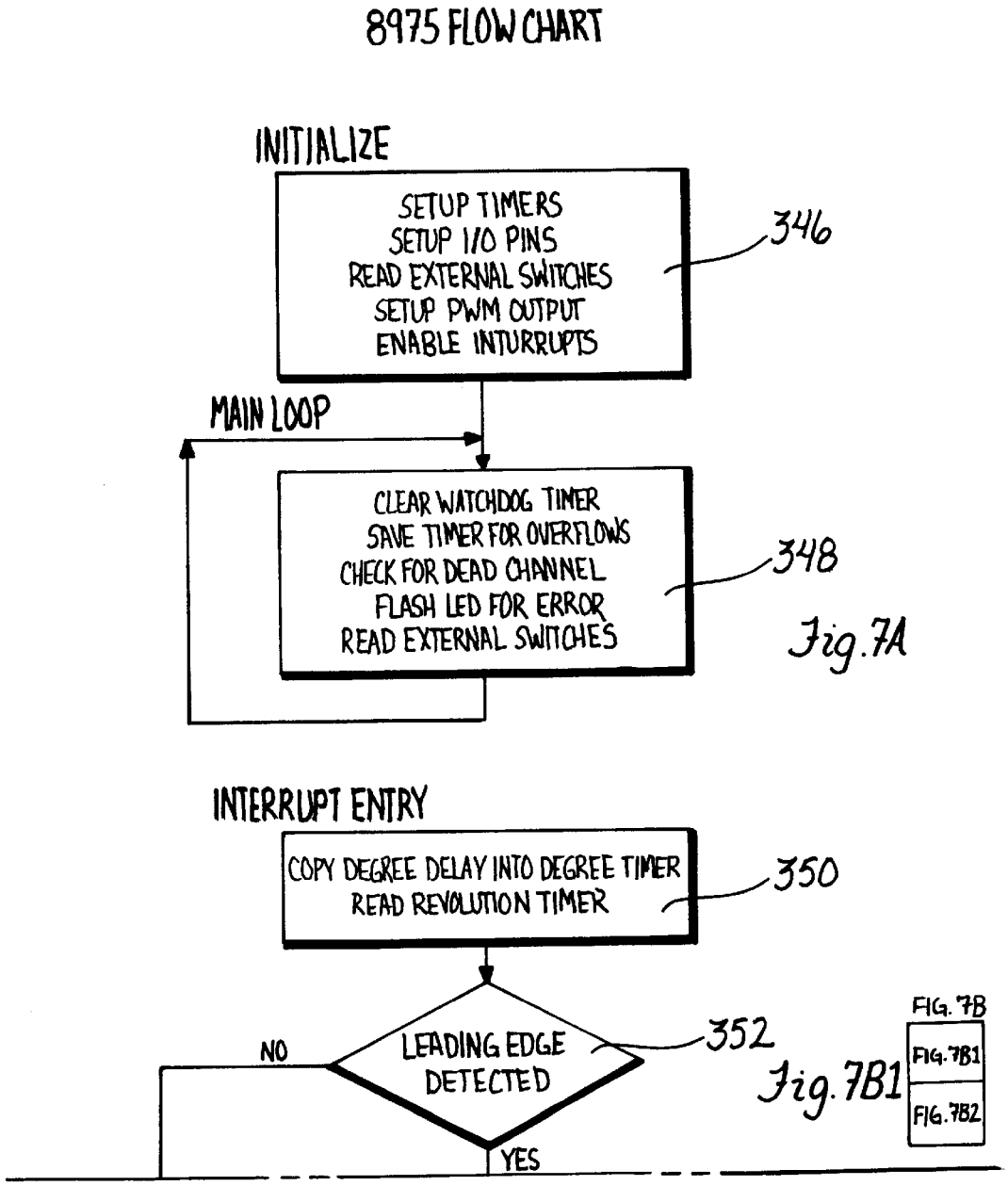
FIGS. 7A–7B are a flow diagram of a second embodiment of the digital ignition system in operation.

Referring to FIGS. 7A–7B, the system is shown in operation in the Second embodiment. In particular, the system initializes in step 346 by setting up the timers and I/O pins, reading external switches, setting up the pulse width modulation output and enabling interrupts. In step 348, the main loop of the program is executed. In particular, in step 348 the watchdog timer is cleared, the timer overflow is saved, a check is made for dead channels, the LED is flashed for an error and external switches are read. The system returns to step 348 in a continuous loop until an interrupt is received.

Upon receiving an interrupt, the system jumps to step 350 wherein the degree delay is copied into the degree timer and the revolution timer is read. The system in step 352 determines whether a leading edge is detected. If not, the system in step 364 checks for a trailing edge and returns to the main program from the interrupt. If, however, a leading edge was detected then in step 354 the LED is turned on. In step 356, the system determines whether a degree delay timeout occurred. If not, then the system once again return to step 356. If so, however, the system proceeds to step 358, wherein the points output is turned on, one revolution time is calculated, degree delay is calculated and load PWM output is calculated and further, the time of 20 degree window is also calculated. In step 360, the system waits until the 20 degree window times out or 17 milliseconds elapses. In step 362 the points output is turned off, the LED output is turned off and the timer is copied to dead time and the retard enable inputs are read. In step 363, the system determines whether the debounce of the trailing edge of the interrupt is completed, wherein the debounce time is a function of the RPM of the system, as described above. If debounce is completed, then in step 365 a trailing edge detected flag is set and in step 364 the system returns to the main program from the interrupt. Otherwise, the system proceeds to step 364 and returns from the interrupt without setting the flag. It is possible that the interrupt entry routine may be executed several times before the flag is set in step 365.

The two embodiments described above may be used independently or together to benefit the timing computer or ignition circuit with increased noise immunity and timing retard reduction.

Figure 8:
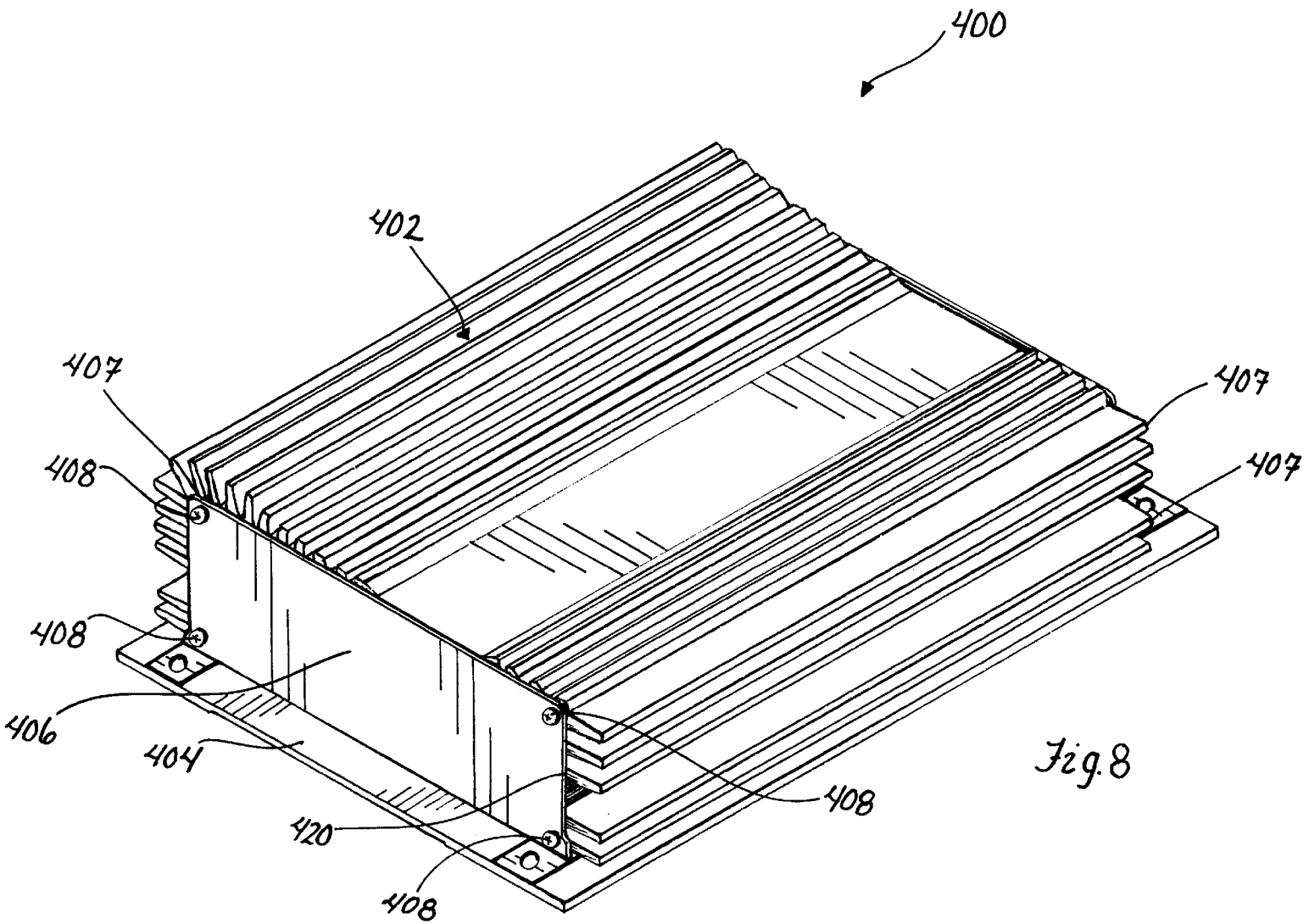
FIG. 8 is a perspective view of the digital ignition system housing.

Turning now to FIG. 8, an exemplary housing unit 400 for holding the electronic ignition system according to the present invention is shown. The housing includes a first housing portion, such as a cover 402, and a second housing portion, such as a base 404 having a wall portion for engaging the digital ignition circuit board. Optionally, end panels 406 may also be included to securely engage the cover to the base. Furthermore, the housing unit 400 may be formed from a metal extrusion, such as aluminum, to provide increased heat sinking capabilities. A plurality of outwardly protruding fins 407 (FIG. 8, FIG. 9) are also provided to facilitate heat dissipation.

Figure 9:
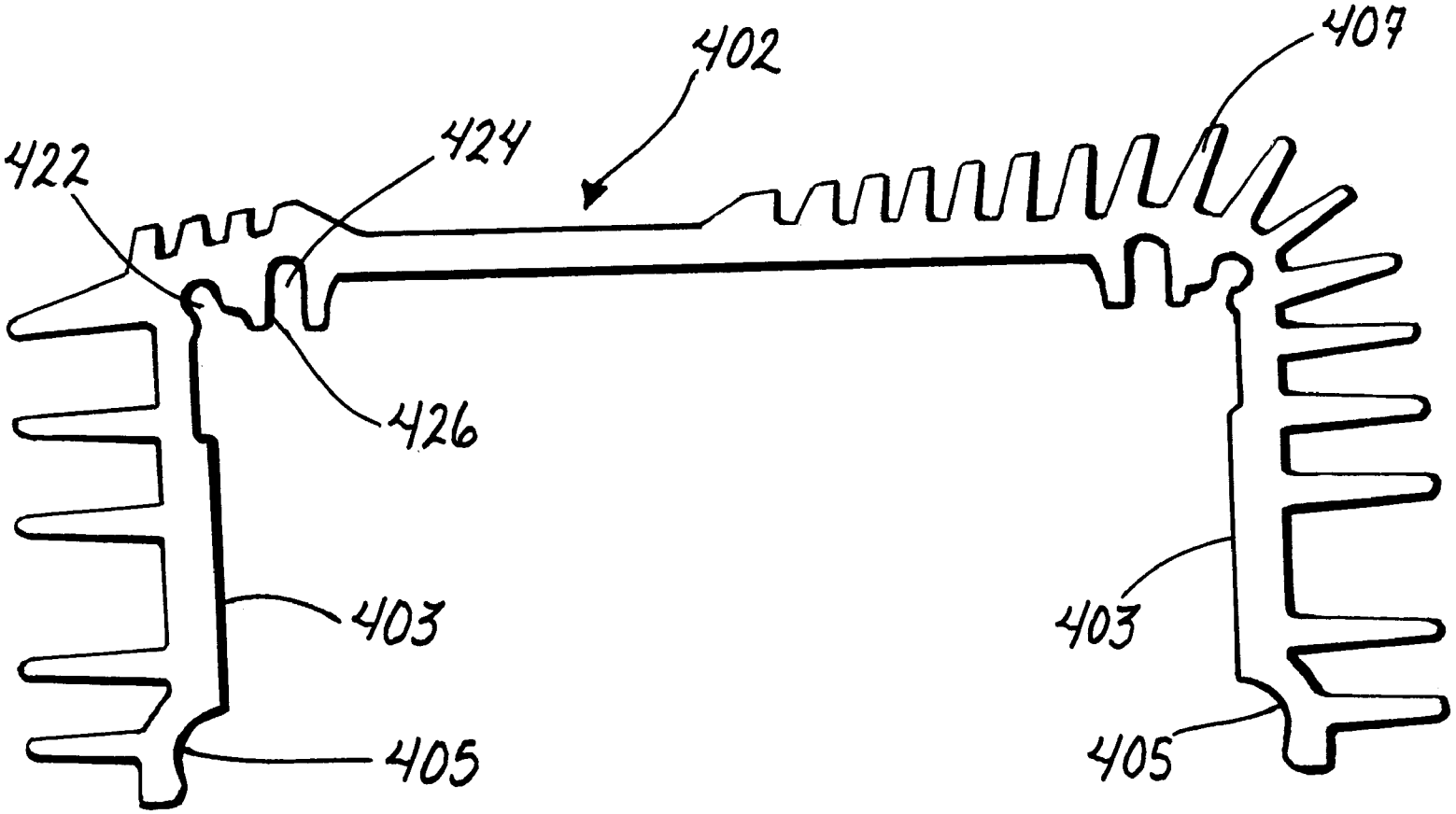
FIG. 9 is a cross-sectional view of the cover of the system housing of FIG. 8.

Referring to FIG. 9, a particular advantage of the housing unit 400 is the ability to quickly assemble the cover 402 to the base 404. In particular, the bottom extrusion 404 (FIG. 10) is snap-fit to the top extrusion. Furthermore, the assembled housing unit conducts heat efficiently from the cover 402 to the base 404 because of the large surface area that is in contact at the mating joint 420.

As shown, the cover 402 is constructed such that the bottom portion of the cover's side-walls 403 includes an inwardly facing outwardly curved portions 405. Similarly, as shown in FIG. 10, the base 404 is constructed such that the top side of the base 404 includes an outwardly facing outwardly curved portion 406 that generally runs the length of the base 404. For aesthetic purposes, the curved portion 406 may be milled such that the curved portion 406 terminates before reaching the ends of the base 404. Thus, when fitting the cover 402 onto the base 404, the wall of the cover 402 having the curved portion expands slightly to fit over the curved portion of the base 404. Once in proper position, the cover 402 forms a snap-fit contact with the base 404 forming the mating joint 420 (FIG. 8).

The cover 402 and the base 404 may also be formed with one or more holes 422 for accepting a fastening device such as a screw 408 (FIG. 8). In addition, the cover 402 and the base 404 may also include or one or more cutouts 424. The cutout 424 may include a series of ripples 426 for also accepting a fastening device. A fastening device may be used to attach the end panels 406 (FIG. 8) to the housing to augment the snap fit. As shown, the end panels 406 may be secured to the housing using two screws 408 on the cover 402 and two screws 408 on the base 404.

A further advantage of the housing unit 400 is its ability to hold power components without requiring screws or other mounting hardware. Therefore, the need for drilling, deburring, insulator bushings and the like becomes unnecessary. In particular, the digital ignition printed circuit board (PCB) assembly is housed in a two piece aluminum extrusion. The power components, Q3, Q5, D7 and Q2 are all mounted on the edge of the PCB and fixed to the extrusion side wall. The case is potted approximately half way, covering the power component tabs and the power transformer T1 using Restech polyurethane compound. This insures waterproofing, vibration resistance and optimal thermal conduction.

The power components are attached to the side wall by double sided adhesive Kapton film tape and clamped during burn-in to set the adhesive. The polyurethane potting compound retains the packages and seals out water and other contaminants found under the hood of an automobile. In particular, the polyurethane is a filled, thermally conductive, fire retardant compound that aids in the heat transfer from all of the heat sources on the PCB assembly to the aluminum extrusion, from where the heat is then radiated into the air on the outside of the extrusion.

The invention described in the above detailed description is not intended to be limited to the specific form set forth herein, but on the contrary, it is intended to cover such alternatives, modifications, and equivalents as can reasonably be included within the spirit and scope of the appended claims.

What is claimed is:

1. An ignition control system for use with an engine ignition coil for receiving voltage within a predetermined operating range, comprising:

an electrical input for receiving a direct current voltage from a power source;

a convertor connected to the electrical input for converting the direct current voltage to a predetermined converted high voltage by first converting the direct current voltage to a high frequency voltage and deriving a high voltage fron the high frequency voltage before applying the predetermined converted high voltage to the ignition coil; and a controller for regulating current available from the convertor to be within the predetermined operating range to allow the convertor to supply proper high voltage to the ignition coil.

2. An ignition control system according to claim 1, wherein the controller comprises an output for providing a reference voltage that tracks the power source direct current voltage for regulating current supply to the convertor.

3. An ignition control system according to claim 1, further comprising a current feedback circuit for determining whether the convertor is operating within a predetermined current range.

4. An ignition control system according to claim 1, further comprising a current limiting circuit for limiting current output from the convertor to reduce current runaway conditions at the controller.

5. An ignition control system according to claim 1, further comprising a temperature control circuit for allowing the convertor to provide the ignition coil a predetermined voltage when the convertor is operating over a range of temperatures.

6. An ignition control system for use with an engine ignition coil for receiving voltage within a predetermined operating range, comprising:

an electrical input for receiving a voltage from a power source;

a convertor connected to the electrical input for converting the voltage to a predetermined converted voltage before applying the predetermined converted voltage to the ignition coil;

a controller for regulating current available from the convertor to be within the predetermined operating range to allow the convertor to supply proper voltage to the ignition coil, the controller having an output for controlling the convertor, the output having different modes based upon operating conditions of the ignition system; and input circuitry for inputting the operating conditions of the ignition system to the controller.

7. An ignition system according to claim 6 further comprising a charge storage circuit for receiving and storing the converted energy from the convertor for application to the ignition coil, and a feedback circuit of the input circuitry for monitoring the charge level of the charge storage circuit supplied by the convertor.

8. An ignition control system according to claim 7 wherein the charge storage circuit includes a reverse current flow path to allow the charge storage circuit to store a predetermined amount of charge when the ignition coil is disconnected from the ignition to ensure proper operation of the convertor.

9. An ignition control system according to claim 7 wherein the output comprises a signal causing the charge storage circuit to stop charging when a reference voltage from the feedback circuit based on the charge level monitored thereby is below a predetermined voltage level to prevent a circuit runaway condition by the charge storage circuit.

10. An ignition control system according to claim 6 wherein the input circuitry comprises a shutdown control circuit for monitoring the power source voltage and the output comprises a signal causing the convertor to shut down to limit overvoltage damage to the ignition control system if the power source voltage exceeds a predetermined threshold voltage.

11. An ignition control system according to claim 10 wherein the shutdown control circuit comprises a clamping circuit for clamping the voltage received by the convertor to a predetermined level to supply a level voltage to the convertor to prevent operation of the convertor at excessively high received input voltages.

12. An ignition control system according to claim 11 wherein the clamping circuit further comprises a current limiting device to limit maximum source current at the convertor to prevent one or more voltage surges to the ignition control system when the clamping device is unclamped and the convertor is operational.

13. A ignition control system according to claim 6 wherein the controller comprises a clamping pin which is clamped at a predetermined voltage level to shut down the convertor and which is unclamped at voltage levels below the predetermined voltage level to allow the convertor to generate the predetermined converted voltage, and the input circuitry comprises a current limiting circuit connected to the convertor to limit the amount of source current at the clamping pin for allowing the controller to regulate the clamping pin output level to minimize power surges.

14. An ignition control system according to claim 13 wherein the current limiting circuit comprises a current limiting device connected between the controller and ground for allowing the current limiting circuit to maintain a predetermined level of current at the clamping pin to minimize oversupply of current at the clamping pin.

15. An ignition control system according to claim 14 wherein the current limiting device comprises one of a resistor and a current diode to provide a soft clamp at the clamping pin.

* * * * *